US009933219B2

(12) United States Patent
Lallier et al.

(10) Patent No.: US 9,933,219 B2
(45) Date of Patent: Apr. 3, 2018

(54) TOY PROJECTILE LAUNCHERS WITH TWO TRIGGER SAFETY LOCKS

(71) Applicant: Hasbro, Inc., Pawtucket, RI (US)

(72) Inventors: John Paul Lallier, North Attleboro, MA (US); David Michael Nugent, Newport, RI (US); Katherine A Mermelstein, East Walpole, MA (US); Tadeusz W Keska, Smithfield, RI (US)

(73) Assignee: Hasboro, Inc., Pawtucket, RI (US)

( * ) Notice: Subject to any disclaimer, the term of this patent is extended or adjusted under 35 U.S.C. 154(b) by 80 days.

(21) Appl. No.: 14/791,294

(22) Filed: Jul. 3, 2015

(65) Prior Publication Data

US 2016/0018175 A1 Jan. 21, 2016

Related U.S. Application Data

(60) Provisional application No. 62/022,077, filed on Jul. 8, 2014.

(51) Int. Cl.

| | |
|---|---|
| ***F41B 7/00*** | (2006.01) |
| ***F41A 9/73*** | (2006.01) |
| ***F41B 7/08*** | (2006.01) |
| ***F41B 5/12*** | (2006.01) |
| ***F41B 11/54*** | (2013.01) |
| ***F41B 11/89*** | (2013.01) |
| ***F41A 17/30*** | (2006.01) |
| ***F41A 17/46*** | (2006.01) |

(52) U.S. Cl.

CPC ..... *F41A 9/73* (2013.01); *F41A 17/30* (2013.01); *F41A 17/46* (2013.01); *F41B 5/12* (2013.01); *F41B 7/08* (2013.01); *F41B 11/54* (2013.01); *F41B 11/89* (2013.01)

(58) Field of Classification Search

CPC .. F41B 5/123; F41B 5/12; F41B 11/89; F41B 11/54; F41A 17/30; F41A 17/46; F41A 9/73

See application file for complete search history.

(56) References Cited

U.S. PATENT DOCUMENTS

| | | | |
|---|---|---|---|
| 961,511 | A | 6/1910 | Marble |
| 1,374,757 | A | 4/1921 | Napier |
| 1,441,975 | A | 1/1923 | Edelin |

(Continued)

OTHER PUBLICATIONS

"Rads 12 Mod Write-up PETG Barrels, Improved Seal, Slightly Improved Airflow" (PSYK) Aug. 6, 2011.

(Continued)

*Primary Examiner* — Melba Bumgarner
*Assistant Examiner* — Amir Klayman
(74) *Attorney, Agent, or Firm* — Perry Hoffman

(57) ABSTRACT

Crossbows having two trigger safety locks. Operatively connected to a trigger is a trigger lock element that in one position prevents the trigger from moving. To prevent inadvertent contact between a cocking slide and a released stretched cord of the crossbow, a slide lock element engages the trigger lock element until the slide lock element is disengaged by the cocking slide moving out of the way. To prevent an improperly configured projectile from being discharged a projectile lock element engages the trigger lock element until a properly configured projectile is loaded onto a drum causing the projectile lock element to disengage from the trigger lock element.

7 Claims, 17 Drawing Sheets

(56) References Cited

U.S. PATENT DOCUMENTS 1,985,079 A * 12/1934 Conklin ..... F41A 9/24 124/25
2,109,589 A 3/1938 Horwitt et al.
2,375,607 A 5/1945 Wulfert
2,422,532 A * 6/1947 Dehm ..... F41A 9/18 42/17
2,483,752 A 10/1949 Buhl
2,725,868 A 12/1955 Foster
2,762,356 A 9/1956 Foster
2,918,050 A * 12/1959 Kopman ..... F41B 5/12 124/25
3,014,308 A 12/1961 Parris
3,016,167 A 1/1962 Richards, Jr. et al.
3,017,874 A 1/1962 Gubash
3,090,148 A * 5/1963 Smith ..... F41A 3/44 42/16
3,116,730 A 1/1964 Tingley
3,717,136 A 2/1973 Gay et al.
3,765,396 A 10/1973 Klenholz et al.
3,774,586 A 11/1973 Saito
3,818,887 A 6/1974 Akiyama et al.
3,913,553 A 10/1975 Braughler et al.
3,968,783 A 7/1976 Pfotenhauer
4,004,566 A 1/1977 Fischer
4,170,215 A 10/1979 Kettlestrings
4,248,202 A 2/1981 Jaworski et al.
4,565,182 A 1/1986 Barnett
4,659,320 A 4/1987 Rich et al.
4,662,345 A * 5/1987 Stephens ..... F41A 9/70 124/25
4,843,751 A 7/1989 Ferri
4,850,328 A 7/1989 Sindel
5,085,200 A * 2/1992 Horton-Corcoran . F41B 5/1469 124/25
5,113,842 A 5/1992 Moormann
5,165,383 A 11/1992 Ebert et al.
5,186,156 A 2/1993 Clayton
5,267,549 A 12/1993 Webber
5,282,453 A 2/1994 Chia
5,292,134 A 3/1994 Schlundt et al.
5,377,656 A 1/1995 Lewinski et al.
5,433,646 A 7/1995 Tarng
5,460,150 A 10/1995 Joppe
5,471,967 A 12/1995 Matsuzaki et al.
5,515,837 A 5/1996 Nin et al.
5,517,780 A 5/1996 Haber et al.
5,529,050 A 6/1996 D'Andrade
5,605,140 A 2/1997 Griffin
5,611,322 A 3/1997 Matsuzaki et al.
5,711,285 A 1/1998 Stewart et al.
5,778,868 A 7/1998 Shepherd
5,797,385 A 8/1998 Thai
5,996,564 A 12/1999 Kotowski
6,224,457 B1 5/2001 Wu
6,500,042 B1 12/2002 LaPointe
6,523,535 B2 2/2003 Rehkemper et al.
6,598,329 B1 7/2003 Alexander
6,733,356 B2 5/2004 Lee
6,799,566 B1 * 10/2004 Malucelli ..... F41B 5/12 124/25
7,096,618 B2 8/2006 McGarry
7,287,526 B1 10/2007 Bligh et al.
7,360,331 B2 4/2008 McGarry
7,418,797 B1 9/2008 Crose
7,437,847 B1 10/2008 Mabry
7,481,209 B1 1/2009 Bligh et al.
7,552,557 B1 6/2009 Mabry
7,640,922 B2 1/2010 Siebelink
7,673,624 B2 3/2010 Rosella, Jr.
7,686,003 B2 3/2010 Witzigreuter et al.
7,753,041 B2 * 7/2010 Ogawa ..... F41B 5/12 124/25
7,938,110 B2 5/2011 Udwin
8,082,909 B2 12/2011 Sopinsky et al.
8,091,539 B2 1/2012 Siebelink
8,146,579 B2 4/2012 Jablonski et al.
D658,726 S 5/2012 Greiner
8,375,928 B1 * 2/2013 Bednar ..... F41B 5/1469 124/25
8,402,958 B2 3/2013 Victor et al.
8,567,378 B2 10/2013 Nugent
2002/0166551 A1 11/2002 Lee
2006/0242880 A1 11/2006 Griffin
2007/0034197 A1 2/2007 Tschech
2007/0261689 A1 11/2007 Tai et al.
2009/0064978 A1 * 3/2009 Matasic ..... F41B 5/12 124/35.1
2010/0147277 A1 6/2010 Zimmerman et al.
2011/0041821 A1 * 2/2011 Brown ..... F41B 7/08 124/27
2012/0024278 A1 2/2012 Carlson et al.
2012/0024279 A1 2/2012 Carlson et al.
2012/0037138 A1 2/2012 Heubl
2012/0125304 A1 5/2012 Brooks et al.
2012/0216786 A1 8/2012 Hadley et al.

OTHER PUBLICATIONS

PCTUS1539191 ISR Transmittal, Written Opinion, Search 1-644 PCT papers dated Dec. 18, 2015.

* cited by examiner

TOY PROJECTILE LAUNCHERS WITH TWO TRIGGER SAFETY LOCKS

PRIORITY CROSS-REFERENCE TO RELATED APPLICATION

This application claims priority pursuant to 35 U.S.C. 119(e) from U.S. Provisional Patent Application No. 62/022,077, filed on Jul. 8, 2014, which Application is expressly incorporated herein by reference.

FIELD OF THE INVENTION

The present invention relates generally to safety locks for toy projectile launchers, and more particularly, to toy launchers having two trigger safety locks that prevent cocking slides or handles from inadvertently snapping forward when a trigger is pulled and that prevent improperly configured projectiles from being discharged.

BACKGROUND OF THE INVENTION

Concern about discharging improperly configured projectile has been a concern for years. For example, a safety valve appears in a patent issued to Nin and D'Andrade, U.S. Pat. No. 5,515,837, granted in 1996, and entitled "Safety Nozzle For Multi-Shot Projectile Shooting Air Gun," and in U.S. Pat. No. 5,529,050, also issued in 1996 to D'Andrade entitled "Safety Nozzle For Projectile Shooting Air Gun." The two patents purport to describe a toy air gun safety valve for firing soft foam darts where the valve does not open unless the dart inserted into a launch tube has a predetermined shape or configuration that matches a configuration of the valve to enable the dart to push the valve to an open position.

Two more recent patents to Bligh, Mead and Brown, U.S. Pat. No. 7,287,526 and U.S. Pat. No. 7,481,209, both entitled "Toy Projectile Launcher With Slidable Outer Cylinder and Stationary Inner Compression Member," the later patent being a divisional of the earlier patent, purport to disclose a safety valve for an air gun. Another launching device patented in 1973, U.S. Pat. No. 3,717,136, entitled "Spring Actuated Projector Having Gravity Fed Magazine," purports to disclose a disc having a serrated edge to be impacted by a pivotal arm biased by a rubber band. The arm has a leading serrated edge to engage the disc and cause the disc to spin. The launcher uses a channel having side rails to limit the width of objects that may be inserted, a top wall to limit the height of such objects, and a bottom trough so that small objects, such as a pencil, will fall into the trough and be unable to be impacted by the pivotal arm to cause discharge.

U.S. Pat. No. 5,165,383 issued in 1992 to Ebert and others for a "Gun with Pivoting Barrel, Projectile Loader, and Trigger Interlock," purports to disclose a safety feature for a BB gun where the gun includes a pivotal barrel and a two position trigger. When latched, the barrel is aligned, the trigger is moved to a firing position, and the gun may be fired. When the barrel is unlatched, the barrel pivots, the trigger is in an at-rest position, and the gun is unable to be fired.

The invention discussed below in connection with the described embodiments address these and other safety deficiencies of the prior art. The features and advantages of the present invention will be explained in or become apparent from the following summary and description of the preferred embodiments considered together with the accompanying drawings.

SUMMARY OF THE INVENTION

In accordance with the present application, an advantageous method and a safe apparatus are disclosed. The apparatus may be any toy launcher designed to discharge projectiles with a predetermined configuration. Each toy launcher has two trigger safety locks that are simple, compact and yet structurally robust. The trigger safety locks have just three main parts, a trigger lock element, a slide lock element and a projectile lock element. The trigger lock element is operatively connected to a trigger to keep the trigger inoperable and is selectively movable in a first direction, generally vertical when the toy launcher is handled in the usual manner. The trigger lock element is engaged by the slide lock element and the projectile lock element to prevent movement of the trigger lock element until certain conditions are met to ensure safety. The slide lock element engages the trigger lock element until a cocking slide of the toy launcher moves the slide lock element out of engagement, the movement of the slide lock element being in a second direction, generally perpendicular to the first direction. The projectile lock element also engages the trigger lock element until a properly configured projectile is loaded onto a drum or in a magazine causing the projectile lock element to disengage from the trigger lock element by moving in the second direction.

The slide lock element engages the trigger lock element to prevent trigger movement until the cocking slide is safely out of the way of the rapidly moving energy generating mechanism. This is done to prevent contact between a rapidly moving energy generating mechanism that is snapping back from a cocked position once the trigger is pulled and the toy launcher cocking slide. Inadvertent contact may create a danger to the user of the toy launcher. To prevent the discharge of an improperly configured projectile, the projectile lock element engages the trigger lock element to prevent trigger movement until a properly configured projectile is loaded in the toy launcher. Once a properly configured projectile is loaded, the projectile moves the projectile lock element from engagement with the trigger lock element thereby allowing the trigger to become operable.

When both the slide lock element and the projectile lock element are disengaged from the trigger lock element, the trigger is freed to move the trigger lock element whereby the energy generating mechanism is released. More particularly, the objects of the present invention are first, to prevent inadvertent contact between the toy launcher cocking slide and the released energy generating mechanism which is rapidly returning to a non-cocked position after being cocked, and second, to prevent nonconforming and potentially dangerous projectiles, such as a pencil, from being discharged from the toy launcher. The toy launchers disclosed herein are safe, simply constructed, fun to use, reliable, relatively inexpensive and yet, structurally robust.

Briefly summarized, the present invention relates to a toy launch apparatus with two trigger safety locks including a housing for supporting a projectile, an energy generating mechanism and a cocking slide, a trigger pivotally mounted to the housing for releasing the energy generating mechanism, a trigger lock element mounted to the housing and operatively connected to the trigger, the trigger lock element being movable between first and second positions, a slide lock element mounted to the housing for selectively engaging the trigger lock element when the trigger lock element is in the first position, the slide lock element being movable by the cocking slide after cocking the energy generating mechanism to cause the slide lock element to disengage from the trigger lock element, and a projectile lock element mounted to the housing for selectively engaging the trigger lock element when in the first position, the projectile lock element being movable by a properly configured projectile to cause the projectile lock element to disengage from the trigger lock element.

The invention also relates to a method for making a toy launch apparatus having two trigger safety locks, the method including the steps of forming a toy launcher having a housing for supporting a projectile chamber, an energy generating mechanism, and a cocking slide, mounting a trigger to the housing, mounting a trigger lock element to the housing, operatively connecting the trigger lock element to the trigger, the trigger lock element being moveable between a first position and a second position, mounting a slide lock element to the housing, operatively connecting the slide lock element to the trigger lock element to selectively engage the trigger lock element when the trigger lock element is in the first position, mounting a projectile lock element to the housing, and operatively connecting the projectile lock element to the trigger lock element to selectively engage the trigger lock element when the trigger lock element is in the first position.

BRIEF DESCRIPTION OF THE DRAWINGS

For the purpose of facilitating an understanding of the inventions, the accompanying drawings and detailed description illustrate preferred embodiments thereof, from which the inventions, their structures, their constructions and operations, their processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
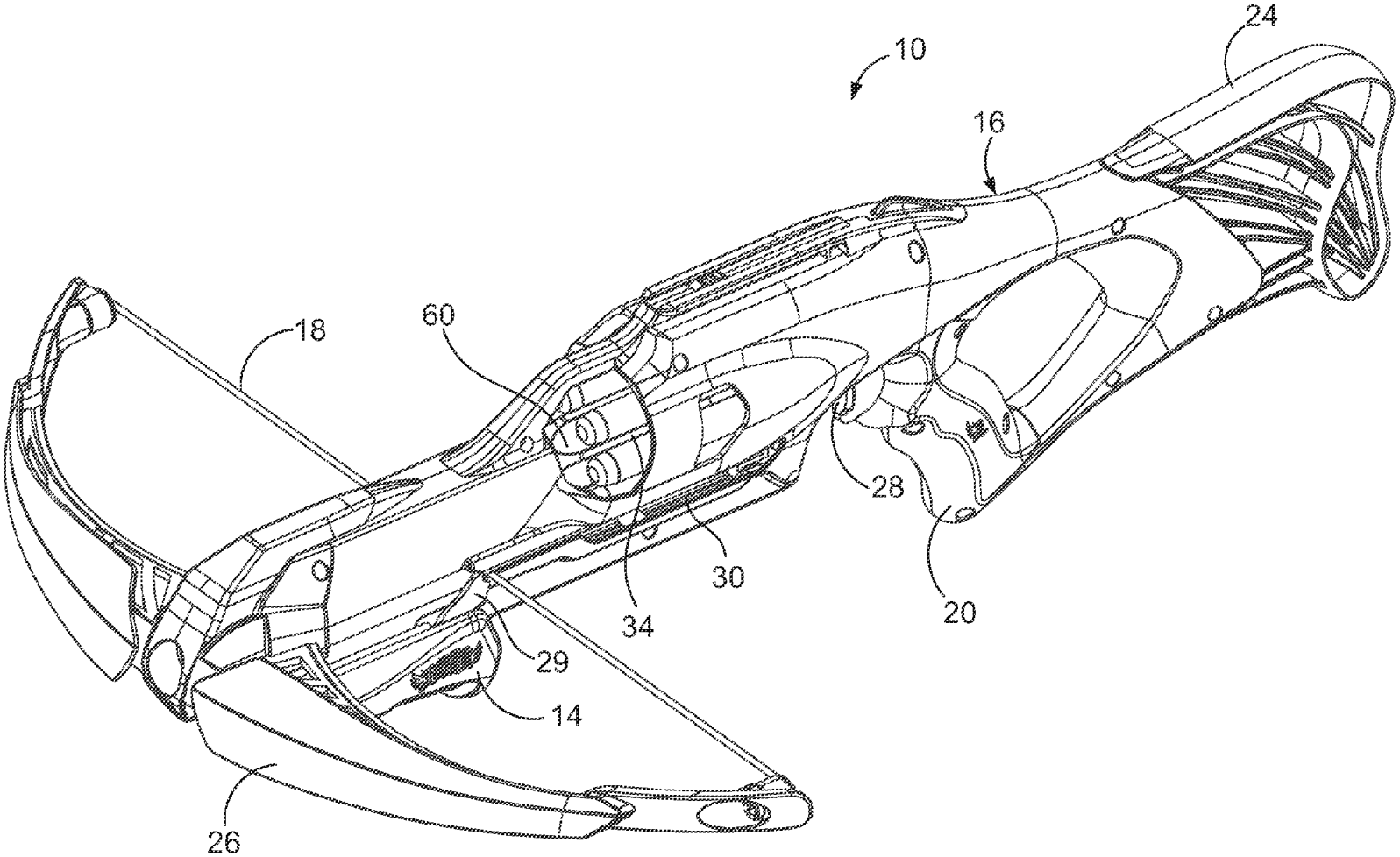
FIG. 1 is a downward looking isometric view of a toy launch apparatus embodiment in the form of a crossbow with a bottom cocking slide, the crossbow being shown in a relaxed configuration.
Figure 2:
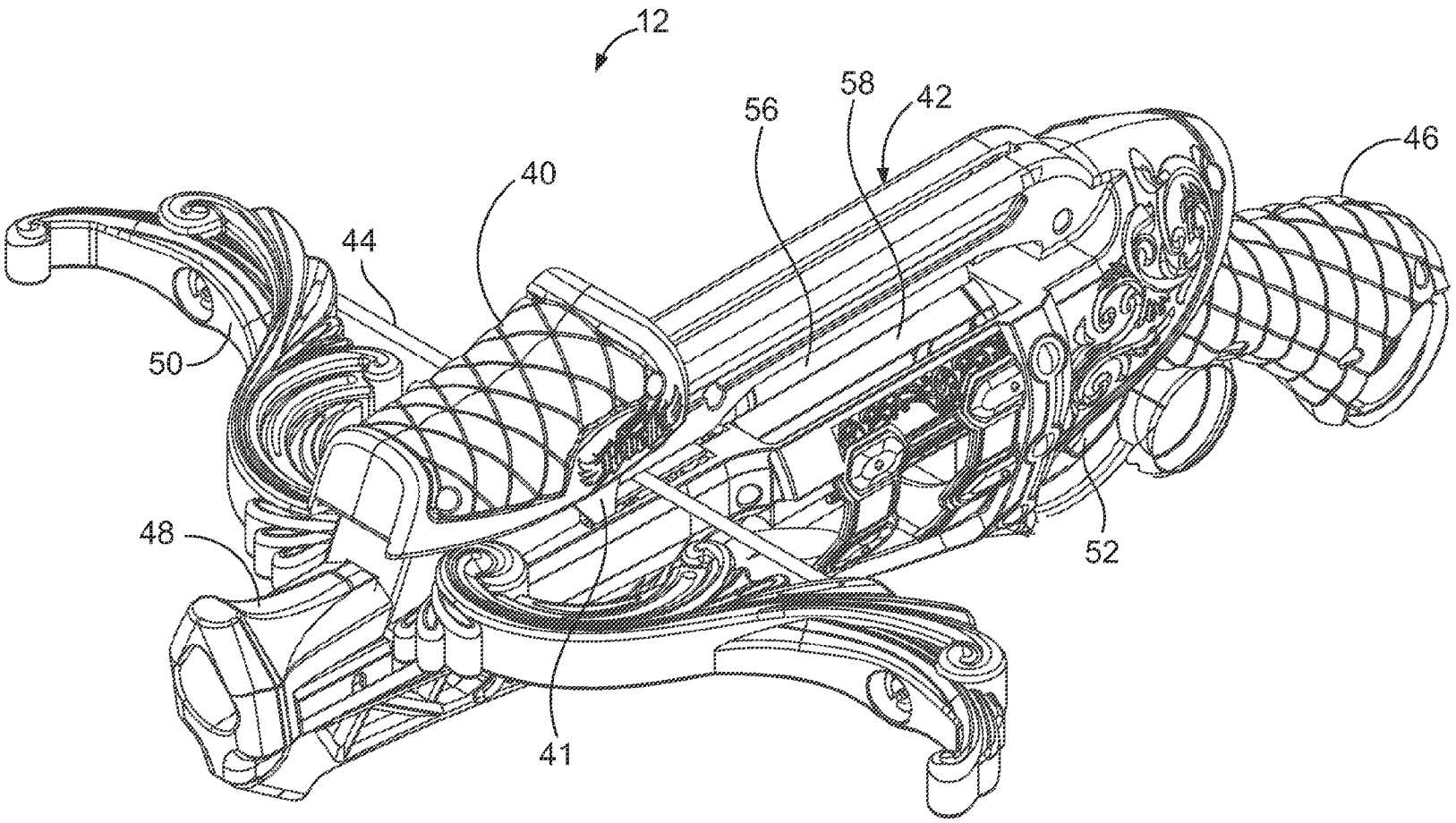
FIG. 2 is a downward looking isometric view of a toy launch apparatus embodiment in the form of a crossbow with a top cocking slide, the crossbow being shown in a relaxed configuration.
Figure 3:
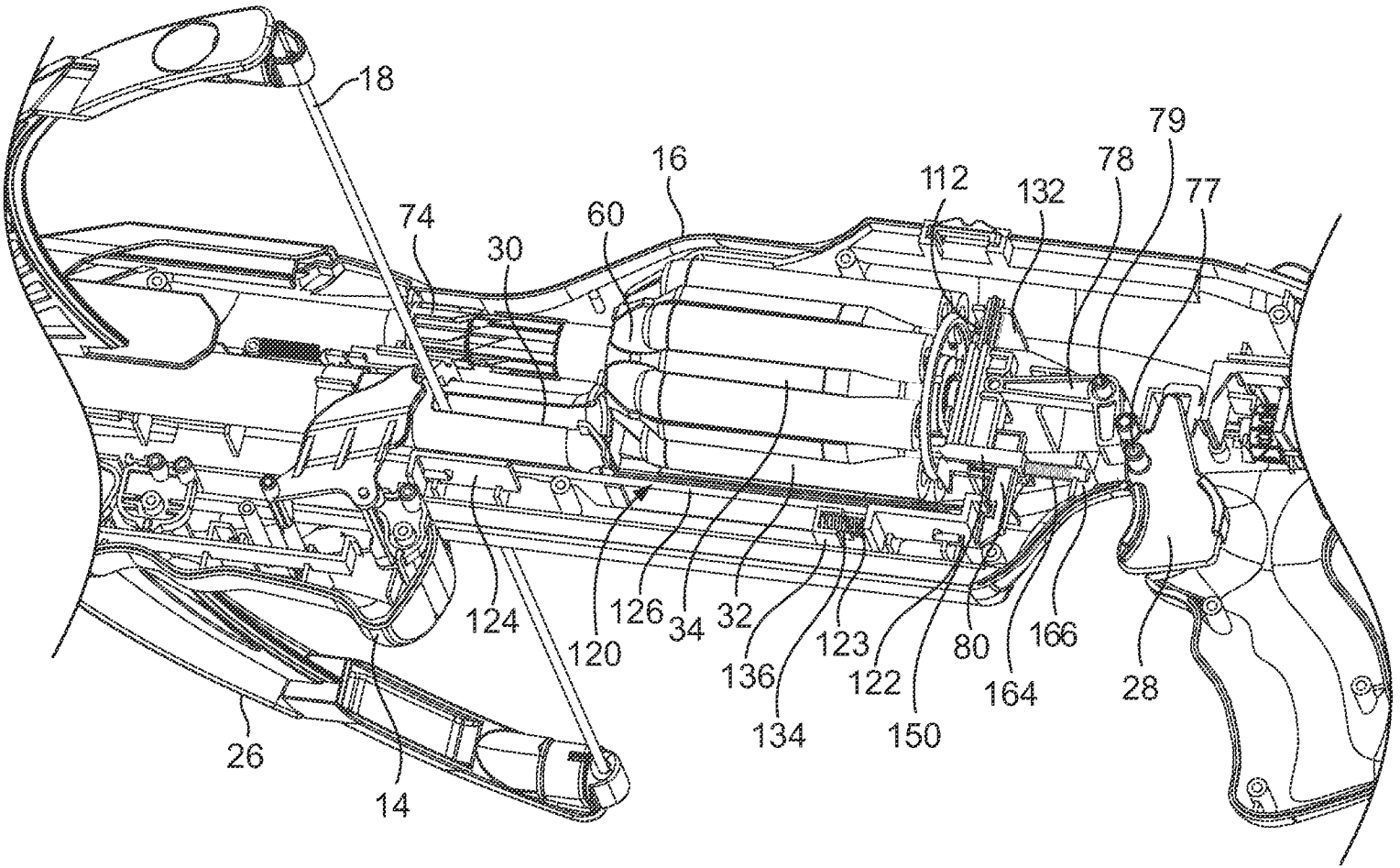
FIG. 3 is an upward looking isometric view of a portion of the toy crossbow shown in FIG. 1, with half of an outer housing removed and with a fully loaded drum.
Figure 4:
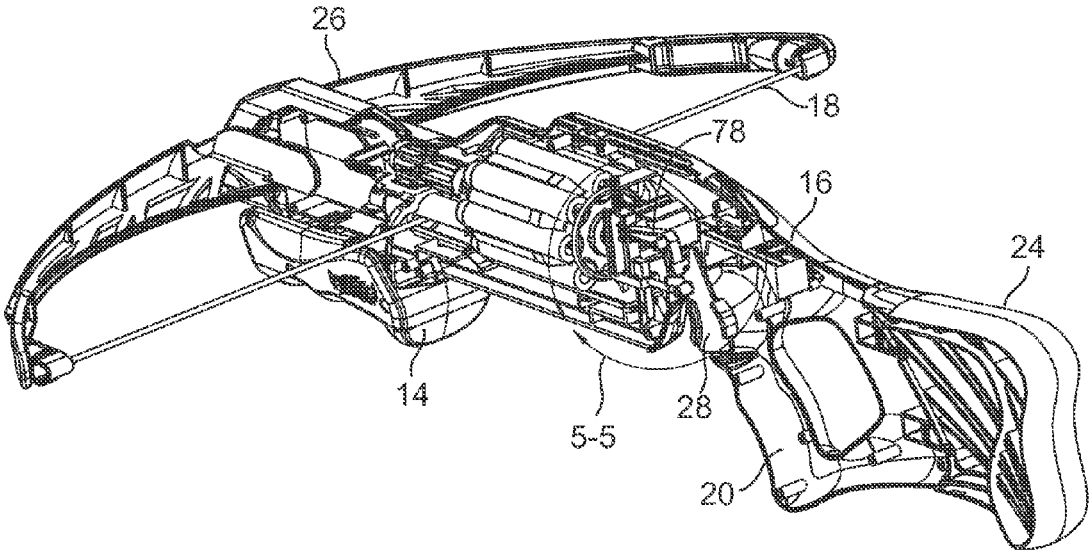
FIG. 4 is an isometric view of the relaxed toy crossbow shown in FIGS. 1 and 3, with half of the outer housing removed and a partially loaded drum.
Figure 6:
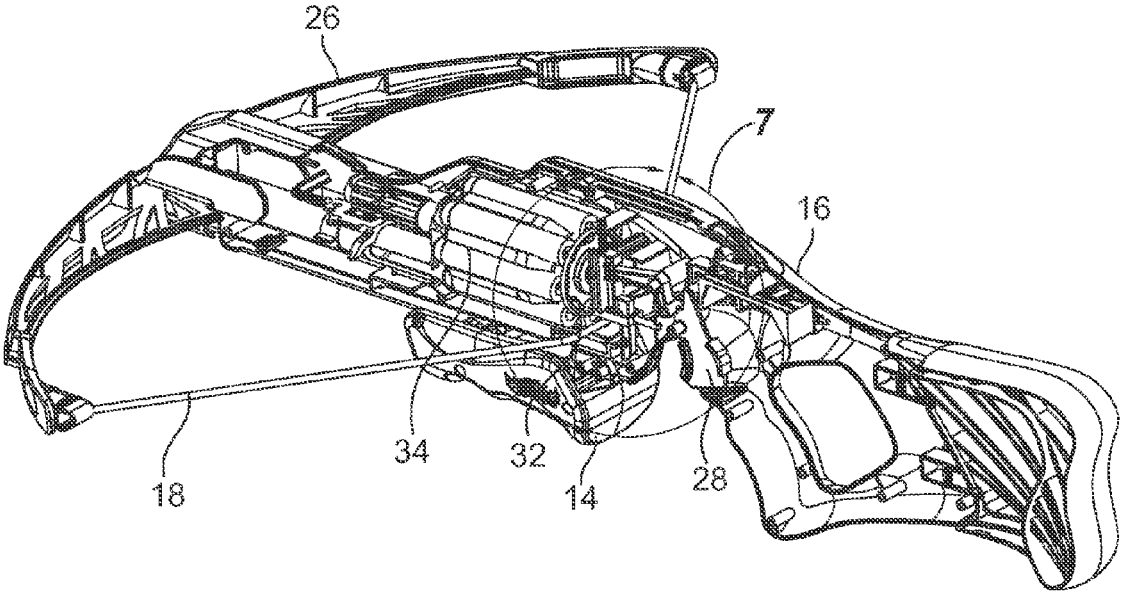
FIG. 6 is an isometric view of the toy crossbow shown in FIG. 4, with the crossbow in a cocked configuration and a fully loaded drum.
Figure 7:
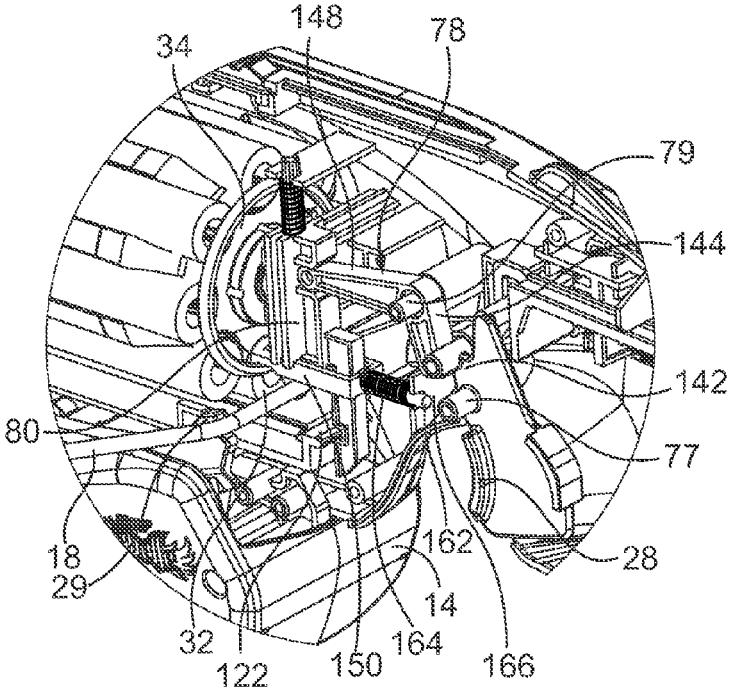
FIG. 7 is an enlarged isometric view taken within the circle 7-7 of FIG. 6.

Referring to FIGS. 1 and 2, there are illustrated two embodiments of toy launch apparatus having trigger safety locks. The first embodiment is in the form of a bottom cocking stylized toy crossbow 10, FIG. 1. The second embodiment is in the form of a top cocking, highly stylized toy crossbow 12, FIG. 2. The bottom cocking toy crossbow 10 includes a cocking slide 14 mounted to a lower portion of an outer housing 16 for moving an energy generating mechanism in the form of a stretchable string or cord 18 from a relaxed position as shown in FIGS. 1, 3 and 4, to a cocked position as shown in FIGS. 6 and 7. The cord is used to generate and transfer energy to a projectile when it is stretched and released. The slide 14 is also part of the energy generating mechanism. The housing 16 includes a grip portion 20 located to the rear of the cord 18 and forward of a stock 24 at the rear of the housing 16. The housing 16 also includes a bow portion 26 at a forward portion of the housing 16 to which the cord 18 is mounted.

A trigger 28 is pivotally mounted to the housing 16 adjacent to the grip portion 20. The stretchable cord 18 is engaged by a hook 29 connected to the cocking slide 14 which moves the cord along a guide ledge 30 formed in the housing 16 from the at-rest position to the cocked, stretched position. (Another hook, not shown, is located on the opposite side of the housing 16.) The cord 18 stores energy when a user of the toy crossbow 10 moves the cocking slide 14 from a forward position shown in FIG. 1, to a rearward position shown in FIG. 6, causing the cord to move from the relaxed position to the stretched position where the cord is restrained. The stretched cord 18 is used to transfer energy to a bottom-most projectile, such as a dart 32, FIG. 3, loaded in an open top dart-carrying magazine drum 34 rotatably supported by the housing 16. When the user pulls the trigger 28 the restrained stretched cord 18 is released and the stored energy is transferred to the dart 32 as the cord snaps back to its relaxed position. A detailed description of the drum is contained in co-pending application entitled TOY LAUNCH APPARATUS WITH OPEN TOP DART DRUM filed on even date and is expressly incorporated herein by reference.

Figure 17:
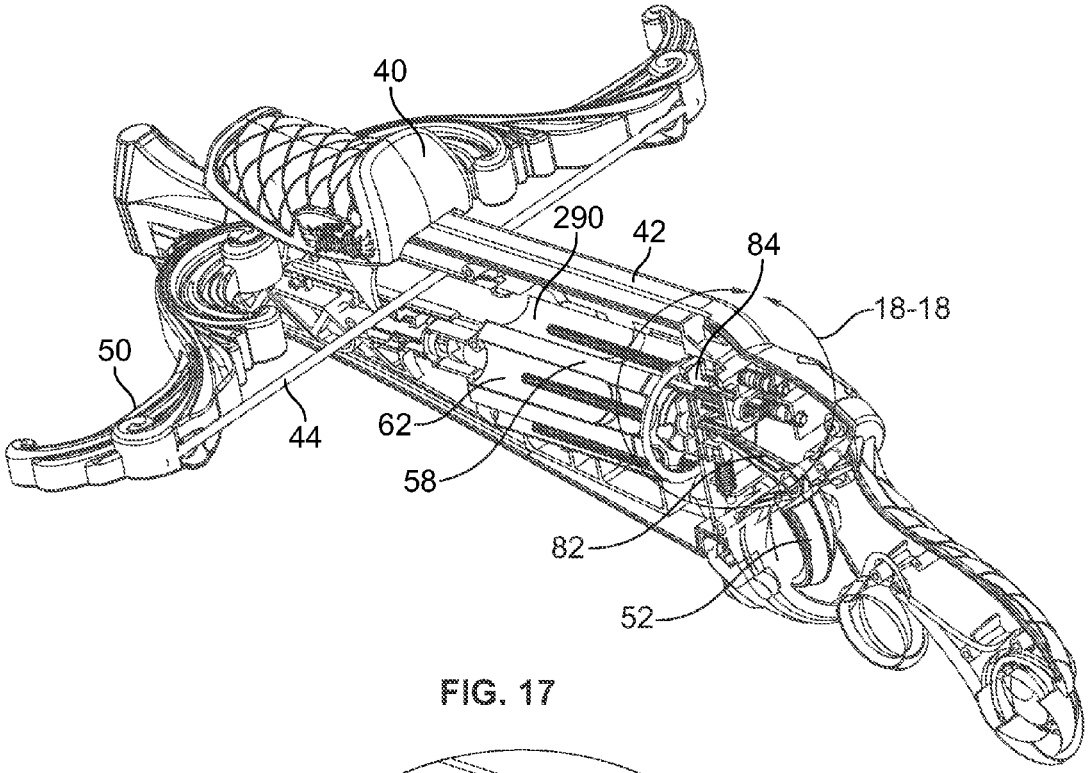
FIG. 17 is a forward looking isometric view of the relaxed toy crossbow shown in FIG. 2, with half of an outer housing removed.
Figure 19:
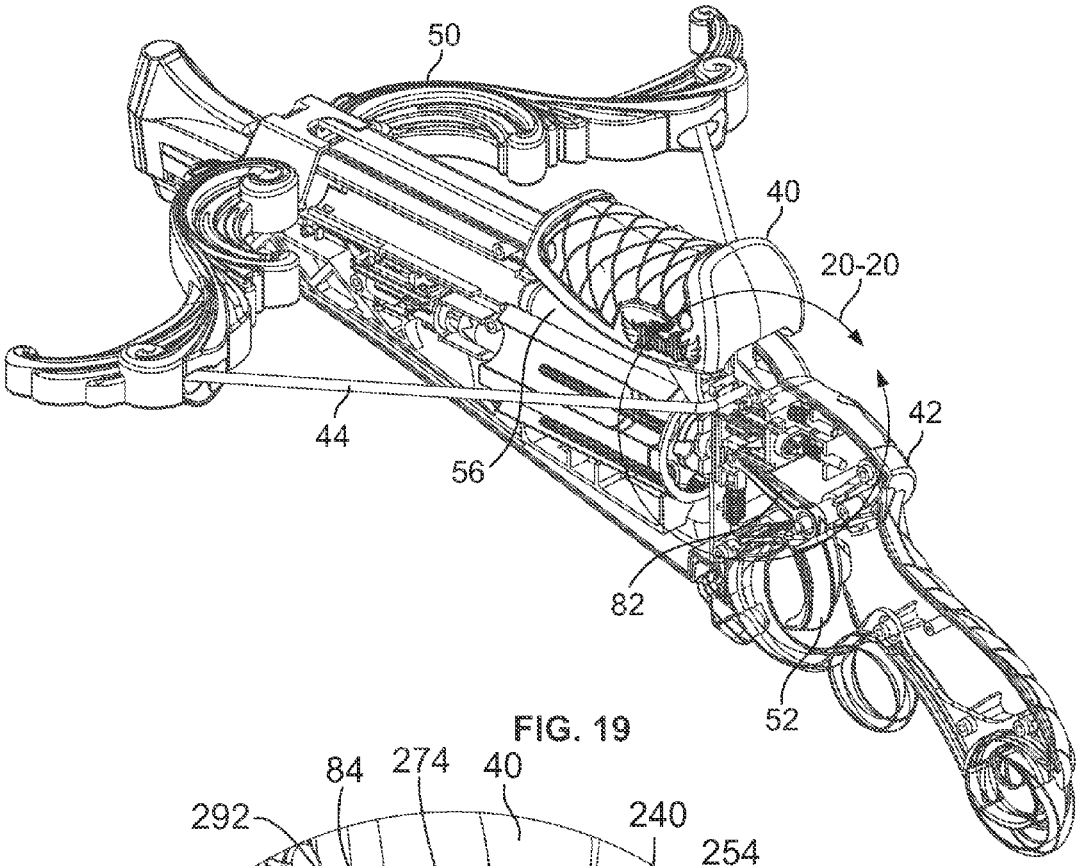
FIG. 19 is a forward looking isometric view of the toy crossbow shown in FIG. 17, with the crossbow in a cocked configuration and a partially loaded drum.
Figure 21:
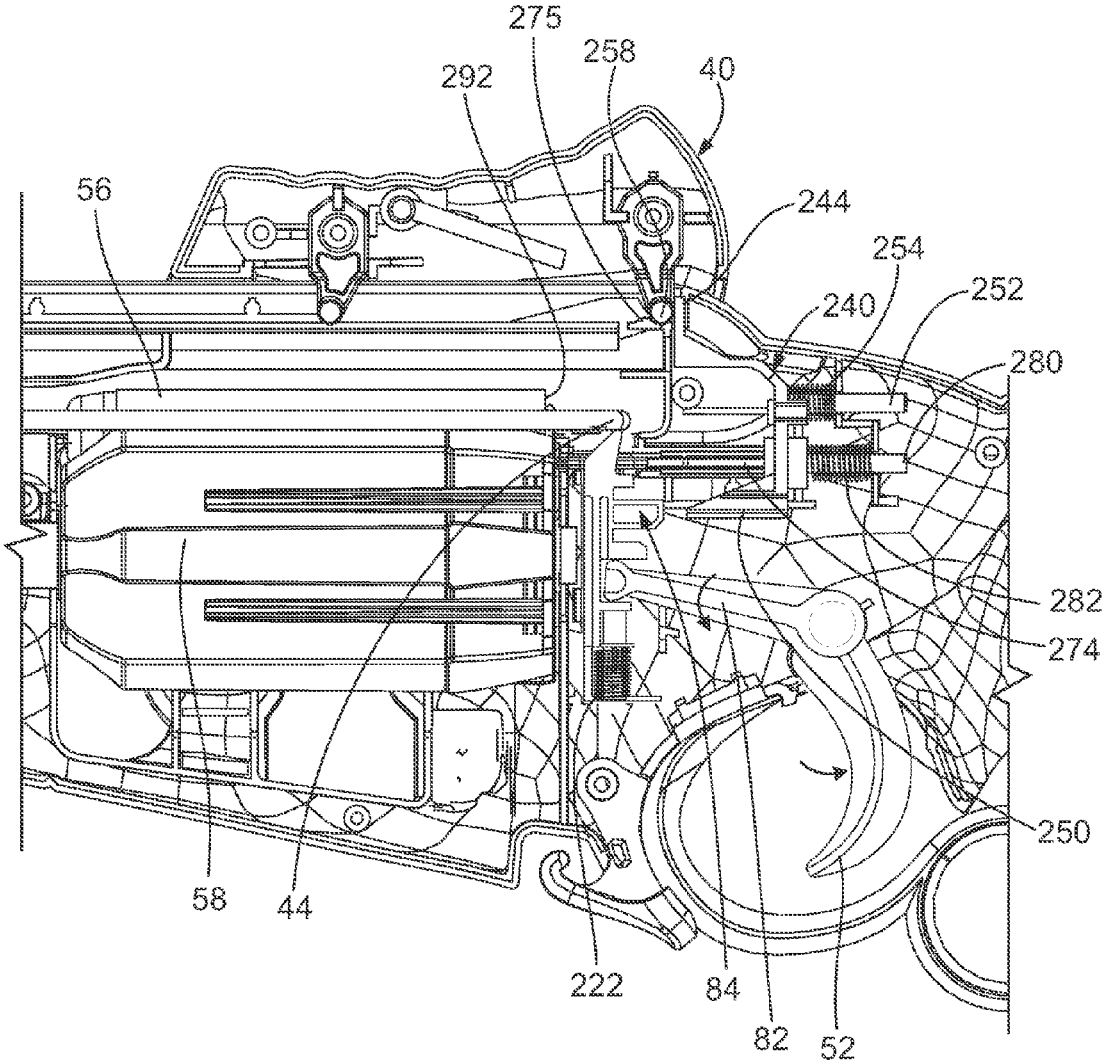
FIG. 21 is a side elevation view of a portion of the toy crossbow shown in FIG. 19, at the moment a trigger is pulled and the energy generating cord is released.

The top cocking toy crossbow 12, FIG. 2, is very similar to the bottom cocking crossbow 10. The toy crossbow 12 includes a cocking slide 40, FIG. 2, with a hook 41 supported by the housing 42 by being mounted to an upper portion of the housing for moving a stretchable cord 44 from a relaxed position as shown in FIGS. 2 and 17, to a cocked position as shown in FIGS. 19 and 21. (Another hook, not shown, is located on the opposite side of the housing 42.) The housing 42 includes a grip portion 46 at the rear, a forward located barrel 48, and to the rear of the barrel 48, a bow portion 50 to which the cord 44 is mounted. A trigger 52 is pivotally mounted to the housing by being mounted forward of the grip portion 46. The stretchable cord 44 is part of the energy generating mechanism that is used to transfer energy from the stretched cord to a top-most projectile, such as a dart 56, loaded in an open top dart-carrying drum 58 which is rotatably supported by the housing. The cord 44 stores energy when a user of the toy crossbow 12 moves the cocking slide 40 from the forward position to the rearward position, causing the cord to move from the relaxed position to the stretched position where the cord is restrained. When the user pulls the trigger 52, the stretched cord is released and the stored energy is transferred to the dart 56 as the cord snaps back to its relaxed position.

Figure 8:
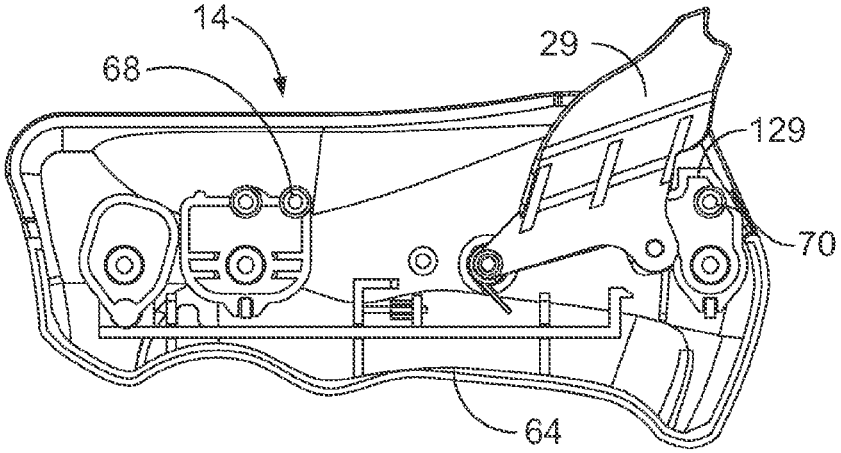
FIG. 8 is a side elevation view of interior parts of a cocking slide for the crossbow shown in FIGS. 1 and 3-7.

The open top drums 34, 58 of the toy crossbows 10, 12, respectively, may each include multiple chambers or recesses, such as the chamber 60, FIG. 1, in the drum 34 and the chamber 62, FIG. 17, in the drum 58, or the crossbows may each have a single shot chamber formed in the housing. The darts stored on the dart drums are preferably formed of soft foam, such as those marketed by Hasbro, Inc. of Rhode Island, under the NERF® brand and described fully in the above mentioned co-pending application incorporated herein. The cocking slide 14 includes an outer casing 64, FIG. 8, the cord hook 29 which may be pivotally mounted, and four guide pins, of which two guide pins 68, 70 are shown, that move in guide grooves in the housing. The cord hook 29 of the crossbow 10, shown in FIGS. 1 and 7, engages the cord 18 when the cocking slide 14 is moved rearward by the user.

Figure 13:
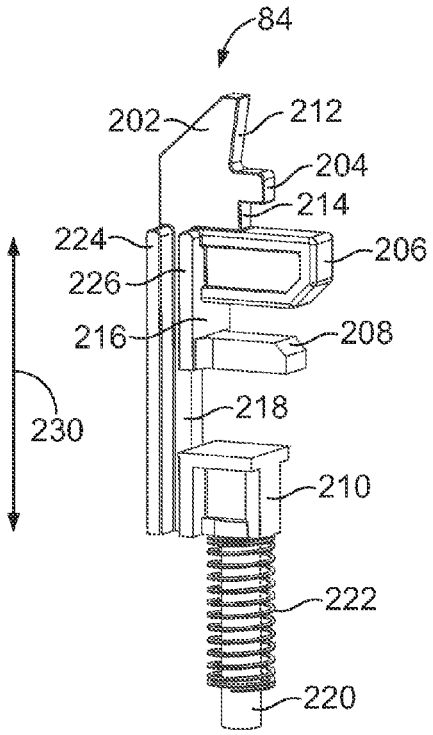
FIG. 13 is an enlarged isometric view of a trigger lock element for the toy crossbow shown in FIGS. 2 and 17-21.
Figure 18:
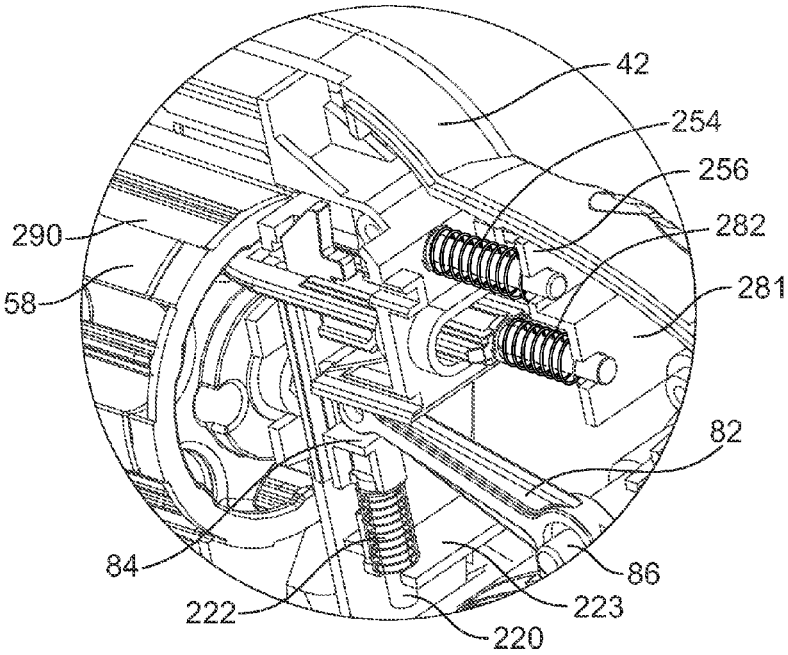
FIG. 18 is an enlarged isometric view taken within the circle 18-18 of FIG. 17.
Figure 20:
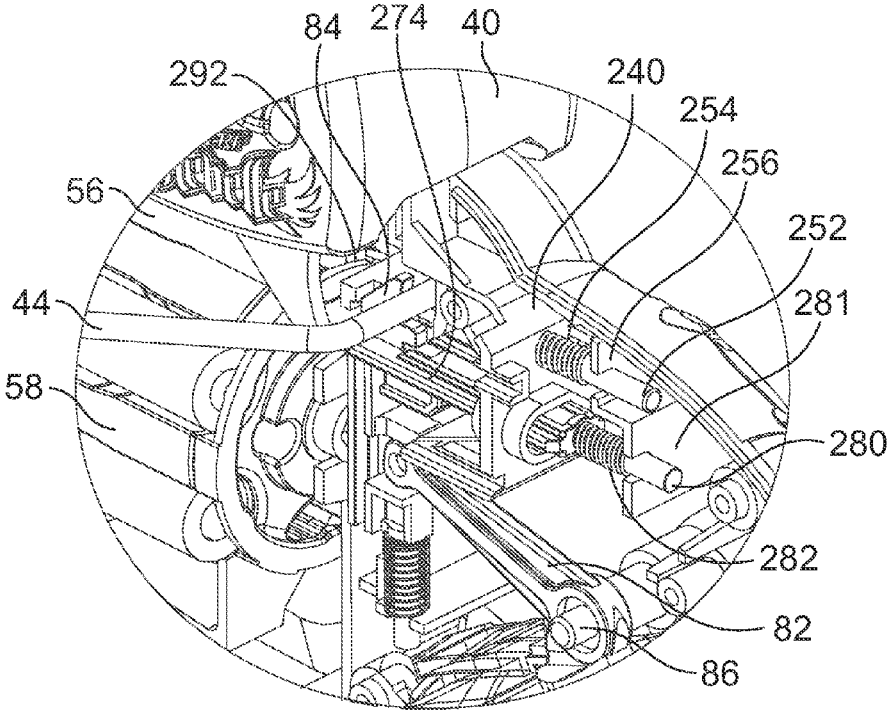
FIG. 20 is an enlarged isometric view taken within circle 20-20 of FIG. 19, but with a fully loaded drum.

Mounted within the housing 16 of the toy crossbow 10 is a cam mechanism 74, FIG. 3, connected to the drum 34 so as to rotate the drum each time the cocking slide 14 is moved from the forward position to the rearward position and back. An identical cam mechanism (not shown) is mounted in the housing 42 of the toy crossbow 12 and is connected to the open top drum 58 to rotate the drum each time the cocking slide 40 is moved from the forward position to the rearward position and back (unless a variation is used as shown in FIG. 21, and described below). The trigger 28, FIG. 3, of the toy crossbow 10 is operatively connected to a forward extending link 78, FIGS. 3-5. The trigger pivots around a shaft 77, FIG. 3, and the link 78 pivots around a shaft 79. The link 78 in turn engages a trigger lock element 80, FIGS. 3, 5, 7 and 9, such that when the trigger 28 is pulled rearward the trigger lock element 80 is moved upward and the cord 18 is released. The freed cord impacts the dart 32, FIGS. 3 and 7, and causes the dart to be discharged from the crossbow. A similar link 82, FIGS. 17-20, is operatively connected to the trigger 52 of the toy crossbow 12 such that when the trigger is pulled rearward a trigger lock element 84, FIGS. 13, 18 and 20, is moved downward and the cord 44 is release. The trigger 52 and the link 82 pivot around a shaft 86, FIGS. 18 and 20. The freed cord 44 impacts the dart 56 and causes the dart to be discharged.

In the alternative, the cord may be replaced by another energy generating mechanism, such as a spring device or battery operated rotating wheels, also described in the above mentioned co-pending application incorporated by reference herein.

As mentioned above, the object of the present invention is to provide two trigger safety locks for each toy crossbow described in detail here, as well as for any other toy launchers where interference between the cord or other energy generating mechanisms and the cocking slide may create a danger to the user, and where items other than properly configured projectiles of suitable material are loaded and attempted to be discharged. More particularly, the objects of the present invention is to make the trigger inoperable to prevent inadvertent contact between the cocking slide and the released cord when the cord is rapidly returning to its relaxed position after being stretched, and use of the launchers to discharge nonconforming and potentially dangerous projectiles, such as a pencil.

The first feature of the trigger safety locks for the bottom cocked toy crossbow 10, FIGS. 1 and 3-7, eliminates the danger from the cord 18 contacting the cocking slide 14 and snapping it forward after the trigger 28 is pulled. To emphasize simplicity, reliability and low cost, the safety lock feature includes just two primary parts. The first part is the trigger lock element 80, FIG. 9, which is mounted in the housing 16 to move between two positions, an engaged or locked position shown in FIG. 5, and a disengaged or unlock position shown in FIG. 11, just before the cord 18 snaps back from its cocked position to its relaxed position. The movement of the trigger lock element 80 between the two positions is parallel to a first axis. When the toy crossbow 10, FIGS. 1 and 3-12, is held and used in the traditional manner, the first axis is disposed generally in a vertical orientation, which is symbolized by a double-headed arrow 90, FIG. 9. The trigger lock element 80 includes a lower cord tab 92, an integral first, upper protrusion 94, an integral second, middle protrusion 96, an integral third, lower protrusion 98, and an integral leg 100 with a first receiving notch 102. The cord tab 92 includes a surface 104 for restraining or holding the cord 18 when the cord is stretched in the cocked position shown in FIGS. 6 and 7. The upper and middle protrusions 94, 96 form in the space between them a second receiving notch 106, and the middle and lower protrusions 96, 98 form in the space between them a third receiving notch 108. The trigger lock element 80 also includes an upper post 110 for mounting a biasing spring 112. Guide arms, such as the element guide arms 114, 116, are provided to mate with housing guide arms (not shown) for support and for facilitating movement of the trigger lock element along the first axis 90.

Figure 5:
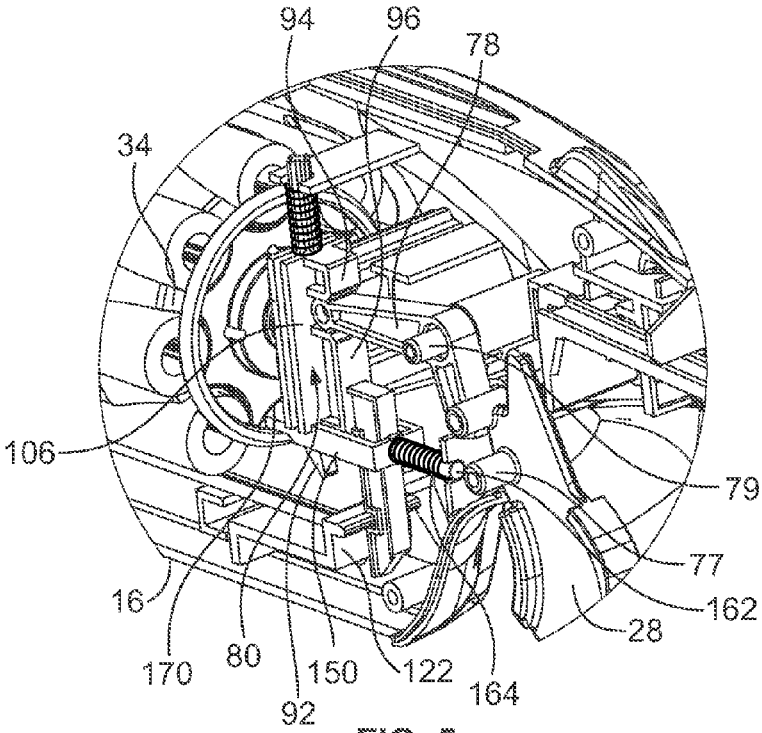
FIG. 5 is an enlarged isometric view taken within the circle 5-5 of FIG. 4.
Figure 9:
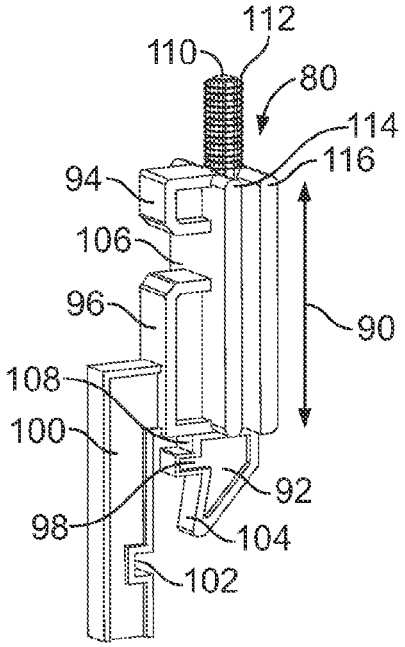
FIG. 9 is an enlarged isometric view of a trigger lock element for the toy crossbow shown in FIGS. 1 and 3-7.

The second notch 106 receives the link 78, FIG. 5, that is operatively connected to the trigger 28 for moving the trigger lock element 80 upward to release the cord 18 from restraint by the surface 104, FIG. 9, of the trigger lock element. The third notch 108 receives a projectile lock element to be described below. The first receiving notch 102 receives a slide lock element 120, FIGS. 3 and 10.

Figure 10:
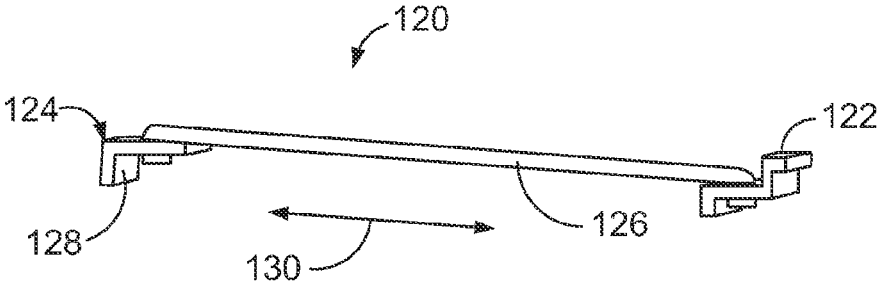
FIG. 10 is an isometric view of a slide lock element for the toy crossbow shown in FIGS. 1 and 3-7.

The second part of the trigger safety lock, to prevent contact between the released stretched cord 18 and the cocking slide 14, is the slide lock element 120, FIG. 10. The slide lock element 120 extends beneath the drum 34 and includes a lock link 122, FIGS. 3, 10 and 11, an abutment link 124 and a rod 126 connecting the lock link 122 and the abutment link 124. The lock link 122 engages the trigger lock element 80 in the first receiving notch 102, FIGS. 5 and 9, to prevent the trigger lock element from moving. The abutment link 124 includes a surface 128, FIG. 10, that is in position to be contacted by an arm 129, FIGS. 8 and 11, of the cocking slide 14. The slide lock element 120 maintains engagement with the trigger lock element 80 while the cocking slide 14 is moved from its forward position to its rearward cocking position. When the slide 14 is returned fully forward, the tab 129 makes contact with and pushes on the surface 128 of the abutment link 124 forward (to the left as viewed in FIG. 11). At the same time the connected rod 126 is also pulled forward as is the lock link 122 causing the lock link 122 to disengage from the trigger lock element 80. The slide lock element 120 moves parallel to a second axis symbolized by a double-headed arrow 130, FIG. 10, where the directions 90 and 130 are generally perpendicular to each other.

Once the trigger lock element is disengaged from the slide lock element 120 the trigger lock element 80 is free to move upward when the trigger is pulled (provided that a proper projectile is loaded in the correct chamber of the drum). However, if the cocking slide 14 is not pushed fully forward and out of the way, no contact is made between the slide 14 and the abutment link 124. Therefore, the lock link 122 does not disengage from the trigger lock element, and pulling the trigger cannot move the trigger lock element. Hence, even though the launcher is cocked, the trigger remains inoperable. When the trigger lock element 80 is free to move and is moved to its upper second position, the biasing spring 112 mounted on the post 110 of the trigger lock element is compressed against a first flange 132, FIG. 3, connected to the housing and biases the trigger lock element to the first position once pressure on the trigger is relieved. Another biasing spring 134 located between the lock link 122 and a second flange 136 connected to the housing is relaxed until the cocking slide 14 presses against the abutment link 124. When the slide 14 pushes on the abutment link 124, the spring 134 is compressed until pressure on the cocking slide is relieved.

When the trigger lock element 80 is freed, the trigger 28 operates on the trigger lock element by rotating around the shaft 77, FIGS. 3, 5, 7 and 11, in a counter clockwise direction. A trigger arm 142, FIG. 7, bears against one arm 144 of the link 78 and rotates the arm 144 clockwise around the shaft 79 causing the other arm 148 of the link 78 to rotate upward and lift the trigger lock element 80 upward away from its first position. This movement results in the stretched cord 18 slipping from the surface 104, FIG. 9, of the trigger lock element 80 and impacting the aligned dart 32, FIG. 7.

Figure 11:
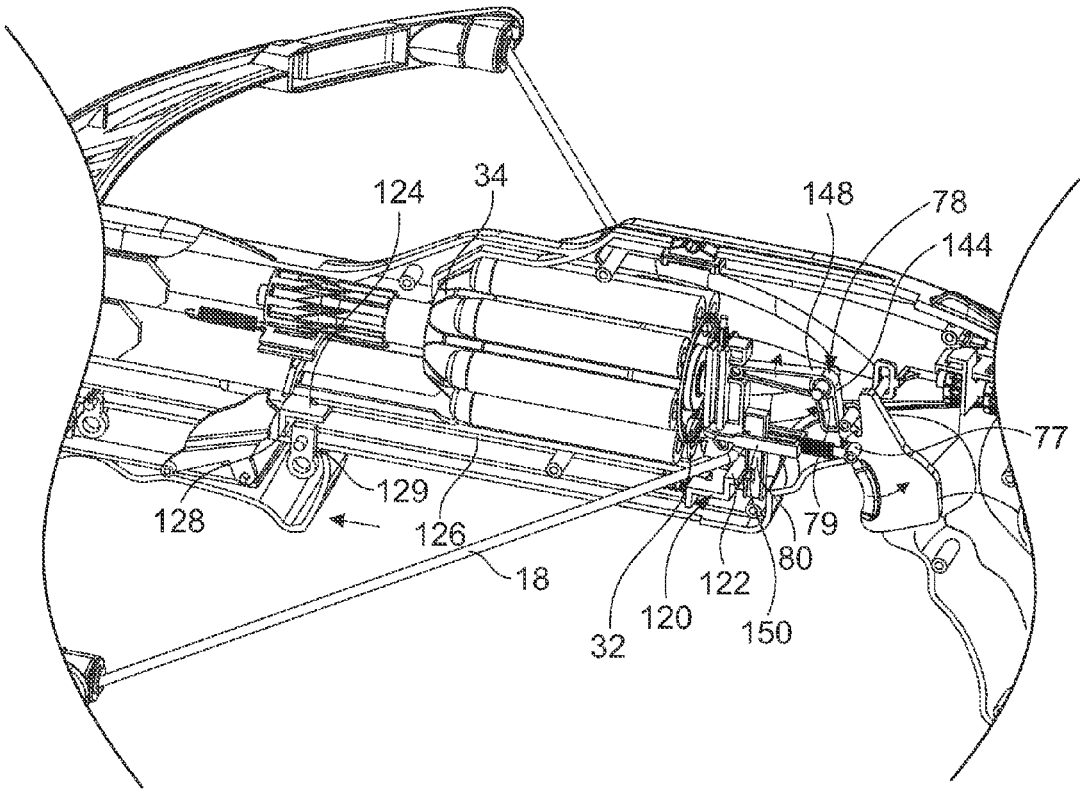
FIG. 11 is an isometric view of a portion of the toy crossbow shown in FIGS. 1, and 3-7, when a trigger is pulled and an energy generating cord is released.

The second feature of the trigger safety locks in the toy crossbow 10 is concerned with the launch of an improperly configured projectile. To prevent such a launch, the trigger is locked and is inoperative. Like the first portion of the safety lock the second feature includes two primary parts. The first part is the trigger lock element 80, FIG. 9, described in detail above. The second part is a projectile lock element 150, FIG. 12, supported by the housing 16 and mounted to move between two positions. In the first position the projectile lock element 150 is engaged with the trigger lock element 80 to prevent movement of the trigger lock element and thereby the trigger. In the second position the projectile lock element is disengaged from the trigger lock element. Movement between the two positions is along the second axis symbolized by the double-headed arrow 130. The projectile lock element 150 includes an abutment nose portion 154, a forward slot 156, a rearward slot 158, a bridge 160 separating the two slots 154, 156, and a post 162. A biasing spring 164 is mounted around the post 162 and seats on the projectile lock element between the projectile lock element 150 and a third flange 166, FIGS. 3 and 7, attached to the housing. The forward slot 156 receives the tab 92 of the trigger lock element 80, and the rearward slot 158 receives the leg 100, as shown in FIGS. 5, 7 and 11. When the projectile lock element 150 is engaged with the trigger lock element 80, the bridge 160 of the projectile lock element 150 is located in the third receiving notch 108 of the trigger lock element 80 between the second and third protrusions 96, 98 thereby preventing movement of the trigger lock element if an attempt is made to pull the trigger.

Figure 12:
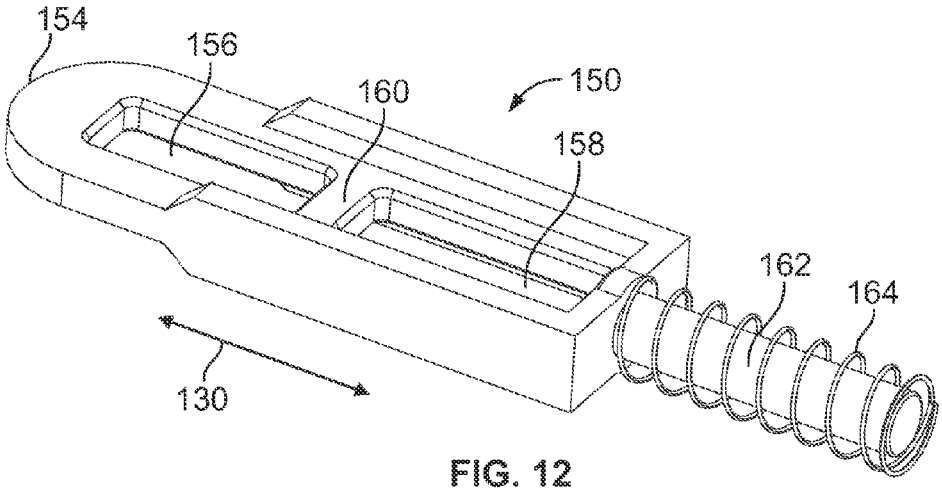
FIG. 12 is an enlarged isometric view of a projectile lock element for the toy crossbow shown in FIGS. 1 and 3-7.

The nose portion 154 of the projectile lock element 150 extends into a lower-most chamber 170, FIG. 5, of the dart drum 34, and if the chamber is empty, as shown, or occupied by an improperly configured object, the projectile lock element 150 is biased by the spring 164 such that the bridge 160, FIG. 12 is located in the third receiving notch 108. An attempted pull of the trigger will cause an interference or abutment between the bridge 160 and the lower protrusion 98. However, when a properly configured dart is loaded, such as the dart 32, FIGS. 7 and 11, the rear surface of the dart will push against the nose portion 154 of the projectile lock element 150 causing the projectile lock element to move rearward against the spring 164. Rearward movement of the projectile lock element 150 will cause the bridge 160 to move away from the third receiving notch 108 of the trigger lock element 80 allowing the trigger lock element to move upward when the trigger is pulled, provided of course that the slide lock element 120 is also disengaged from the trigger lock element 80 as shown in FIG. 11. If the drum chamber 170, FIG. 5, fails to contain a properly configured dart, the projectile lock element 150 will not be moved against the spring 164 and the trigger lock element 80 will not be able to move upward when an attempt is made to pull the trigger.

In operation of the toy launch apparatus 10, the user loads a properly configured dart 32 into the bottom chamber of the drum 34, which is aligned with the stretched cord 18. The user cocks the crossbow by pulling the cocking slide 14 all of the way rearward and then all of the way forward before or after loading the dart. If done correctly, both the slide lock element 120 and the projectile lock element 150 disengage from the trigger lock element 80 so that when the user pulls the trigger 28, the dart 32 will be discharged. However, if a properly configured projectile is not loaded onto the drum or if no projectile is loaded, the projectile lock element will not be disengaged from the trigger lock element and the trigger lock element will not be moved in response to an attempted pull of the trigger. Furthermore, if the cocking slide is not fully returned to the forward position, the slide lock element 120 will remain engaged to the trigger lock element 80 such that the trigger is inoperative.

In the alternative, the trigger lock element, the slide lock element and the projectile lock element may be configured differently, provided that there is an interference between a trigger lock element and a slide lock element should the cocking slide not be fully returned forward after cocking, and provided that there is an interference between a trigger lock element and a projectile lock element should a non-conforming projectile or no projectile be loaded onto the drum. Of course, the housing configuration may be altered and different styling themes may be employed, such as STAR WARS® or GI JOE®.

The dart launching toy crossbow 12, FIG. 2, may have nearly identical internal elements as the crossbow 10 except that the cocking slide and the slide lock element are mounted at or near the top of the housing 42 and other internal elements are altered accordingly. An alternate version may be configured somewhat differently as shown in FIGS. 13-21, but operation of the crossbow 12 is similar. For example, the trigger lock element 84, FIG. 13, may be configured to include an upper cord tab 202, an integral first protrusion 204, an integral second protrusion 206, an integral third protrusion 208, and an integral fourth protrusion 210. The cord tab 202 includes a surface 212 for restraining the cord 44 when the cord is stretched and the crossbow is cocked.

The first and second protrusions 204, 206 form in a space between them a first receiving notch 214, the second and third protrusions 206, 208 form in a space between them a second receiving notch 216, and the third and fourth protrusions 208, 210 form in the space between them a third receiving notch 218. The trigger lock element 84 also includes a post 220 for mounting a biasing spring 222. The spring 222 is seated between the fourth protrusion 210 of the trigger lock element 84 and a first flange 223, FIG. 18, connected to the housing 42. Guide arms, such as the trigger lock guide arms 224, 226, FIG. 13, are provided to mate with housing guide arms (not shown) to support the trigger lock element in position and for facilitating movement of the trigger lock element along a first axis symbolized by the double arrow 230.

Figure 14:
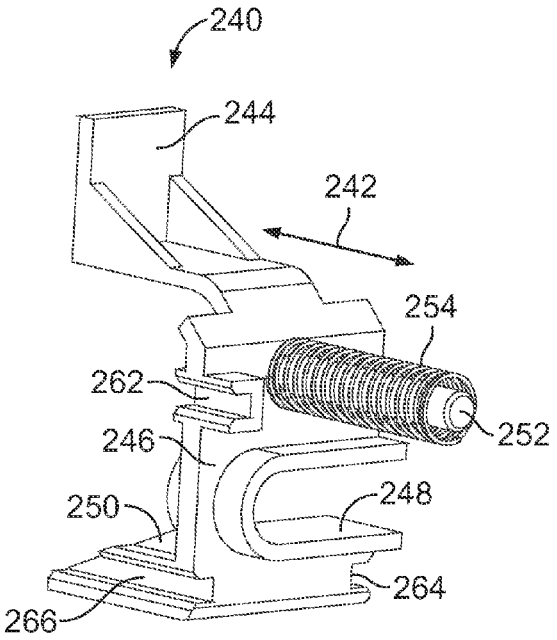
FIG. 14 is a forward looking enlarged isometric view of a slide lock element for the toy crossbow shown in FIGS. 2 and 17-21.
Figure 15:
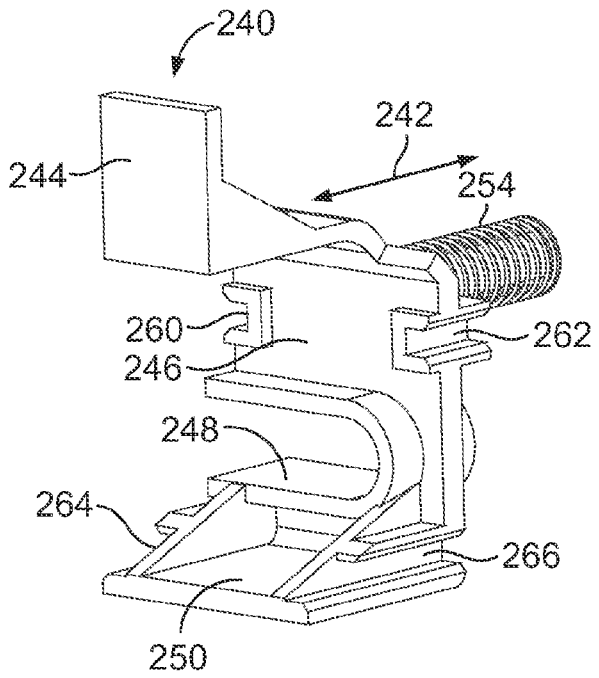
FIG. 15 is a rearward looking isometric view of the slide lock element shown in FIG. 14.

Mated with the trigger lock element 84 to prevent contact between the released stretched cord 44 and the cocking slide 40 is a slide lock element 240, FIGS. 14 and 15. The slide lock element is mounted to the housing 42 to move between a first position engaged with the trigger lock element 84 as shown in FIG. 18, and a position disengaged from the trigger lock element as shown in FIG. 21. The movement is parallel to a second axis symbolized by a double arrow 242, FIGS. 14 and 15, generally perpendicular to the first axis 230, FIG. 13. The slide lock element 240 includes a first, abutment panel 244, an integral second, middle panel 246 including a pass-through opening 248, and a third, lock panel 250. Integral with the middle panel 246 is a post 252 extending rearward and around which is mounted a spring 254 for biasing the slide lock element 240 into engagement with the trigger lock element 84. The spring 254 extends between the middle panel 246 and a second flange 256, FIG. 18, connected to the housing. The abutment panel 244 is positioned in a forward location compared to the remainder of the slide lock element 240 to insure that first contact is made between the slide lock element and a guide pin 258, FIG. 21, of the cocking slide 40 when the cocking slide is moved rearward to cock the crossbow 12 and stretch the cord 44 around the tab 202 of the trigger lock element 84. The lock panel 250 is configured to engage the trigger lock element 84 in the second receiving notch 216 between the second and third protrusions 206, 208. Glide slots 260, 262, 264, 266, FIGS. 14 and 15, are provided in the slide lock element 240 to engage guide arms connected to the housing (not shown) to facilitate smooth movement of the slide lock element.

Figure 16:
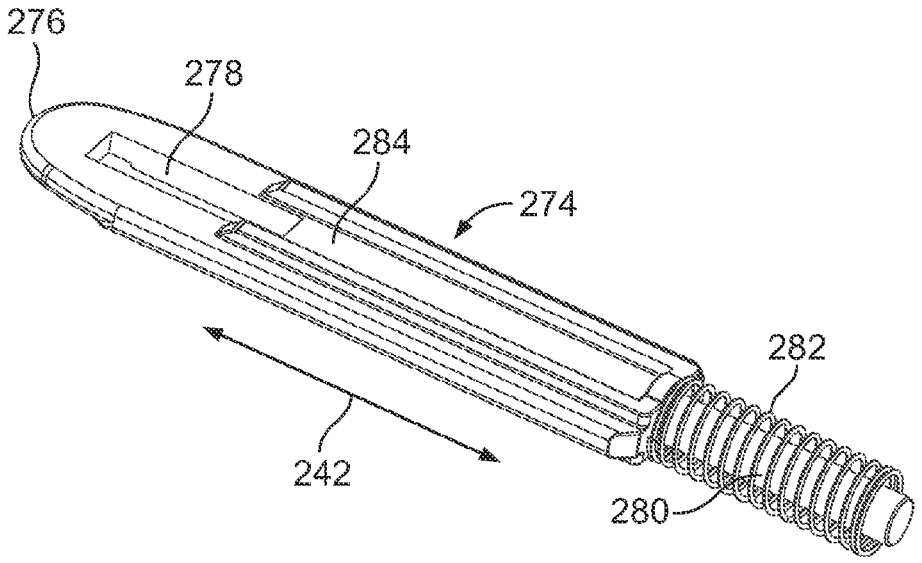
FIG. 16 is an enlarged isometric view of a projectile lock element for the toy crossbow shown in FIGS. 2 and 17-21.

The trigger 52, FIG. 17, of the crossbow 12 is connected to the link 82, FIGS. 17 and 18, and the link is engaged with the trigger lock element 84 in the third receiving notch 218 between the third and fourth protrusions 208, 210. When the trigger is pulled, the link 82 presses downward on the fourth protrusion 210 of the trigger lock element to lower the trigger lock element 84 and release the stretched cord as shown in FIG. 21. When the cocking slide 40 is pulled fully rearward, the cord 44 is stretched and restrained by the surface 212, FIG. 13, of the tab 202 and the crossbow is cocked. The cocking slide 40 also contacts the abutment panel 244, FIGS. 14 and 15, of the slide lock element 240 and causes the slide lock element 240 to be moved rearward (to the right in FIG. 21) so as to disengage the lock panel 250 from the second receiving notch 216 of the trigger lock element 84, thereby freeing the trigger lock element 84 to move downward when the trigger is pulled, provided, however, that a projectile lock element 274, FIG. 16, is also disengaged from the trigger lock element 84. When the cocking slide 40 is pulled fully rearward by a user, the guide pin 258 moves rearward of a bump or detent 275, FIG. 21, which restrains the cocking slide in its rearward position along with the slide lock element 240. A similar detent arrangement may be used with the toy crossbow 10.

The second feature of the trigger safety locks in the crossbow 12 concerns the discharge of improperly configured projectiles and includes two primary parts, the trigger lock element 84, FIG. 13, already described in detail above, and the projectile lock element 274, FIG. 16. The projectile lock element 274 is supported by the housing and is mounted to move between two positions. In one position the projectile lock element 274 is engaged with the trigger lock element 84. In a second position the projectile lock element is disengaged from the trigger lock element. The movement of the projectile lock element is parallel to the second axis 242. The projectile lock element 274 includes a nose portion 276, a slot 278, and a post 280. A biasing spring 282 is mounted to the post 280 and is seated between the projectile lock element 274 and a third flange 281, FIG. 18, connected to the housing 42. The slot 278 of the projectile lock element receives the tab 202 of the trigger lock element 84, and a wall portion 284, FIG. 16, located rearward of the slot 278 of the projectile lock element is received in the notch 214, FIG. 13, between the first and second protrusions 204, 206 to engage the trigger lock element 84 and prevent movement of the trigger lock element should an attempt be made to pull the trigger. Should the trigger be pulled there will be an interference between the wall portion 284 of the projectile lock element 274 and the first protrusion 204 of the trigger lock element 84 and the trigger will not move.

The nose portion 276, FIG. 16, of the projectile lock element 274 extends into an upper-most chamber 290, FIG. 18, of the dart drum 58, and, like the projectile lock element 150 of the toy crossbow 10, if the chamber is empty or occupied by a misconfigured object, the projectile lock element 274 remains in the engaged position with the trigger lock element 84 because of the biasing spring 282. The wall portion 284 of the projectile lock element is positioned in the first receiving notch 214 to prevent movement of the trigger lock element. When a properly configured dart is loaded in the chamber 290, such as the dart 56, FIGS. 19 and 20, the rear ring shaped rear surface 292, FIG. 21, of the dart will push against the nose portion 276 of the projectile lock element 274 causing the projectile lock element to move rearward (to the right in FIG. 21) against the spring 282. Rearward movement of the projectile lock element 274 will cause the wall portion 284 to move away from the first receiving notch 214 of the trigger lock element 84 allowing the trigger lock element to move downward when the trigger is pulled, provided of course that the slide lock element 240 is also disengaged from the trigger lock element 84.

In operation of the crossbow 12, the user mounts and stores a properly configured dart onto the drum 58, either before or after the cord 44 is stretched. The user cocks the crossbow 12 by pulling the cocking slide 40 fully rearward. If done properly, both the slide lock element 240 and the projectile lock element 274 disengage from the trigger lock element 84 so that when the trigger is pulled the trigger lock element moves downward to release the cord 44 and the dart 56 will be discharged. However, if a properly configured projectile is not loaded onto the drum the projectile lock element will not be disengaged from the trigger lock element and the trigger lock element will not move in response to a pull on the trigger.

Figure 22:
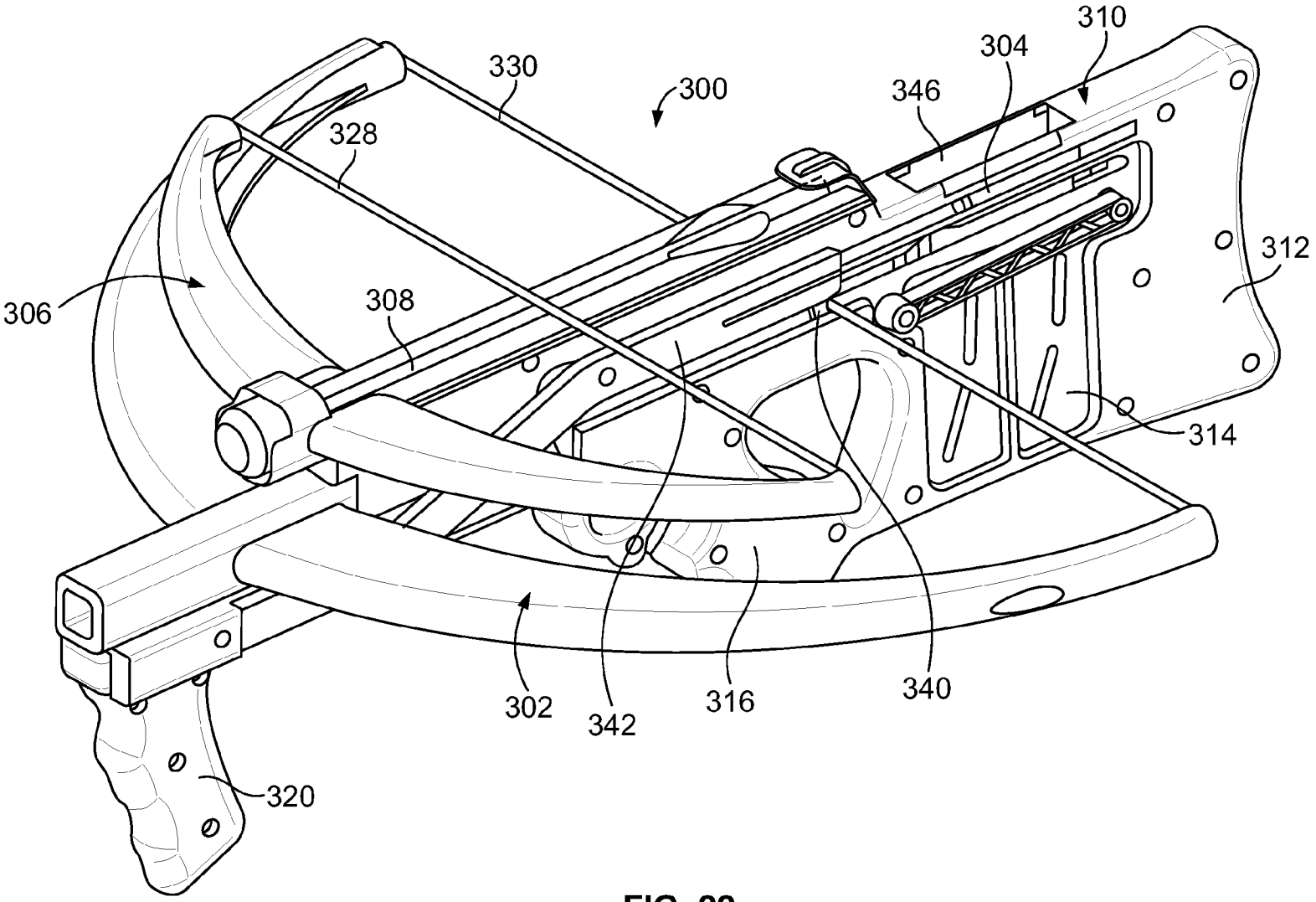
FIG. 22 is a downward looking isometric view of a toy launch apparatus embodiment in the form of a double decker crossbow.
Figure 23:
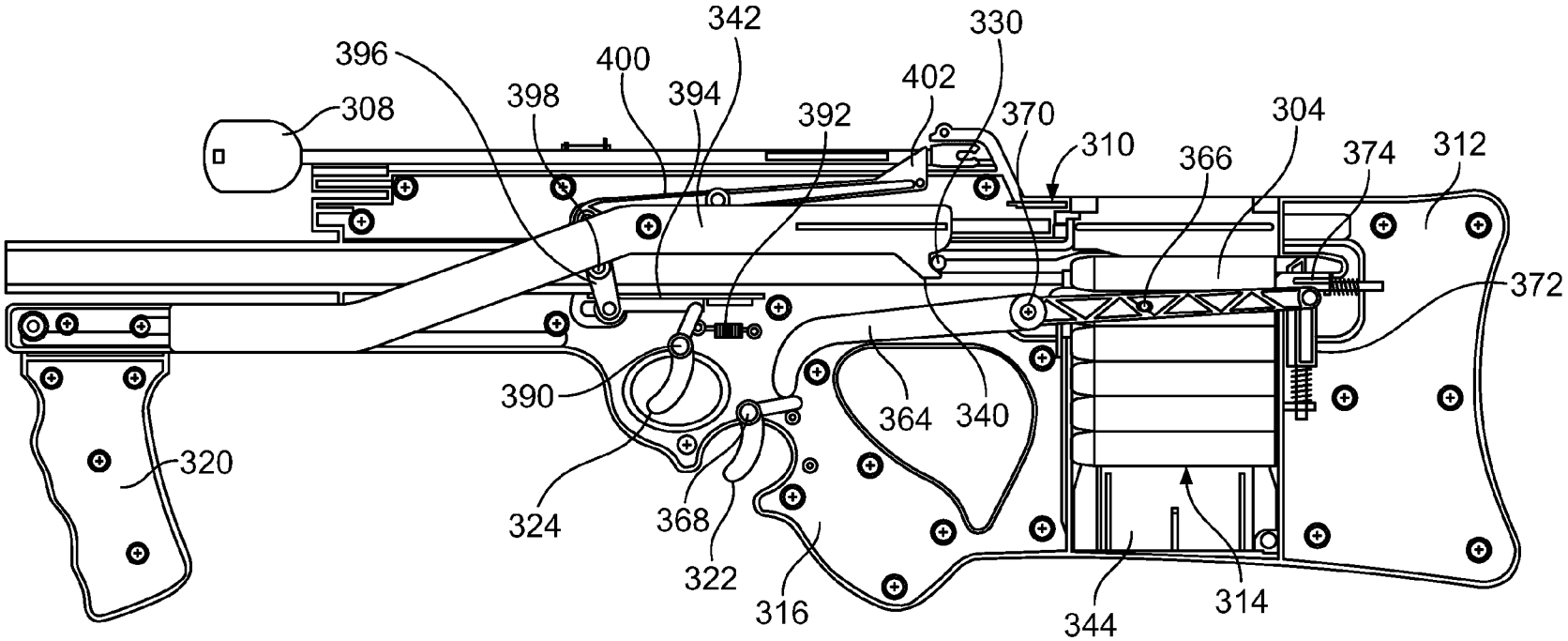
FIG. 23 is a side elevation view of the toy crossbow of FIG. 22, with half of the housing removed.
Figure 24:
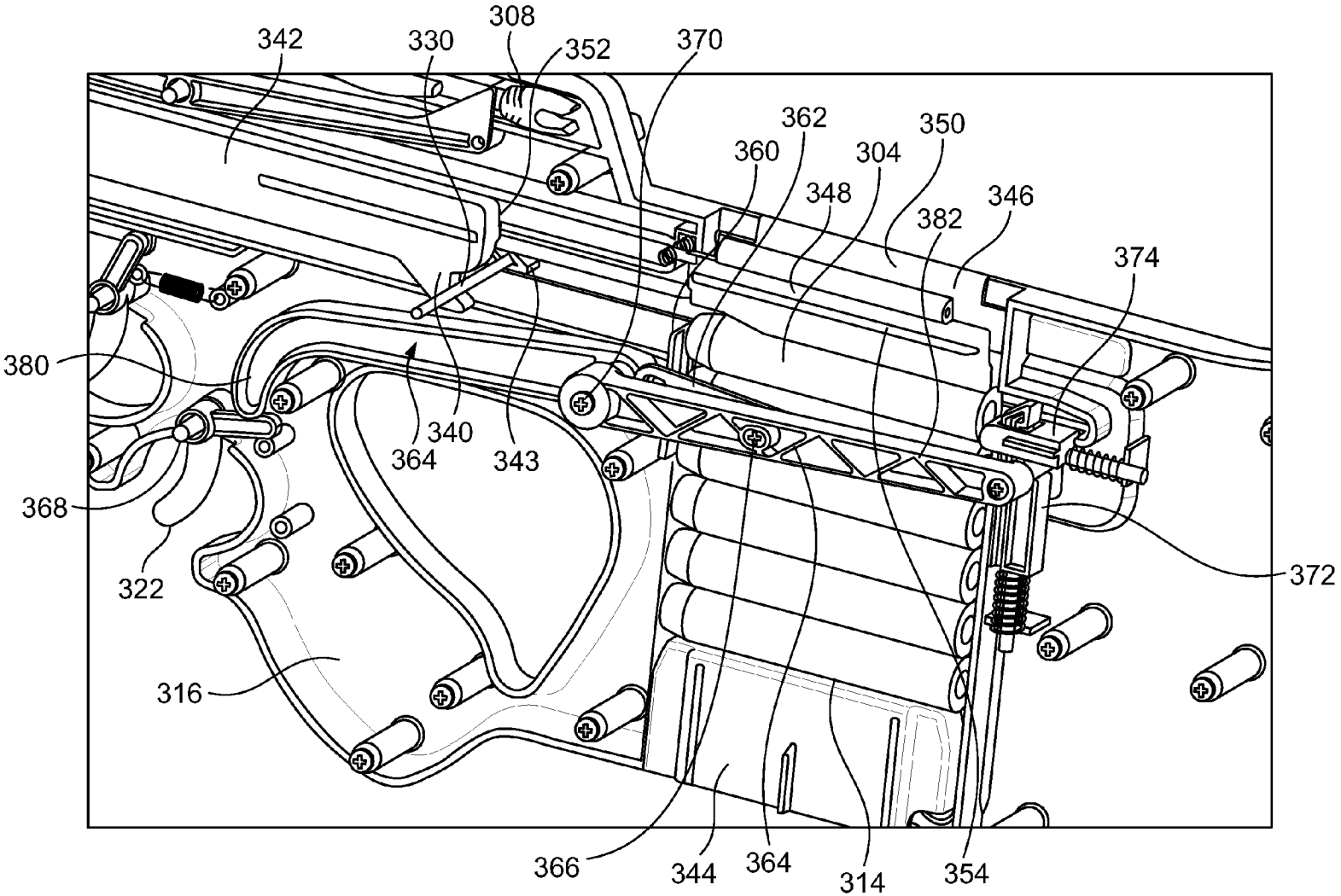
FIG. 24 is an enlarged isometric view of a portion of the toy crossbow shown in FIG. 23.

Referring now to FIGS. 22-25, there is illustrated yet another embodiment of a toy launch apparatus having the trigger safety lock feature in the form of a double decker toy crossbow 300. The double decker toy crossbow 300 has a bottom cocking toy crossbow 302, FIG. 22, for discharging darts, such as the dart 304, and a top toy crossbow 306 for discharging an arrow or bolt 308. The double decker crossbow 300 includes a housing 310 with a stock portion 312, a built-in dart magazine 314, a grip portion 316, the bottom bow portion 302 and the top crossbow 306. The bottom cocking toy crossbow 302 includes a cocking or pump handle 320 mounted to a lower portion of the housing 310. The cocking handle 320, like in the toy crossbows 10, 12, moves a lower stretchable string or cord 330 from a relaxed position as shown in FIGS. 22 and 24, to a cocked position which is shown at the moment of discharge in FIG. 25. Two triggers, a lower dart trigger 322 and an upper bolt trigger 324 are mounted to the housing. An upper cord 334 is mounted to the top crossbow 306 and the lower cord 330 is mounted to the bottom crossbow 302.

A hook 340, FIGS. 22-24, that is integral with a cocking link 342, which in turn is connected to the cocking handle 320, engages the lower cord 330. Another cocking link 343, FIG. 24, is located on the opposite side of the housing 310. The dart magazine 314 includes a spring-biased pusher 344 at the bottom and an opening 346, FIG. 22, at the top. Mounted in the opening 346 are oppositely mounted pivoting doors 348, 350, FIG. 24. Darts are loaded into the magazine 314 through the top opening 346 and passed the doors 348, 350. During the cocking process, a slot 352, FIG. 24, in the cocking link 342 engaging a side flange 354 on the door 348 to cause the door 348 to rotate and press downward. An identical slot and flange arrangement moves the other door 350. The downward movements of the doors 348, 350 bear upon the top most dart 304 to ensure that the dart is properly seated. The doors 348, 350 compress the top most dart to prevent distortion and shredding when the cord 330 impacts the dart.

Forward of the magazine is a dart gate 360, FIG. 24, and a gate link 362 connected to a trigger link 364 by a shaft 366, FIGS. 23 and 24. The trigger link 364 abuts the lower trigger 322 and the lower trigger is pivoted around a fastener 368 connected to the housing 310. The trigger link 364 pivots around a fastener 370 and extends to a trigger lock element 372. The trigger lock element 372 restrains the lower cord 330 in the cocked position very much like the earlier described trigger lock elements 80, FIG. 9, and 84, FIG. 13. A dart lock element 374, like the projectile lock elements 150, FIG. 12 and 274, FIG. 15, is mounted to the housing to keep the trigger lock element 372 from moving until a properly dimensioned dart is loaded. The dart lock element 374 operates like the projectile lock elements 150, 274. The dart gate 360 insures that a dart pushed upward from the magazine 314 is properly seated because the dart gate biases the dart against the dart lock element 374 and causes the dart lock element to move rearward (to the right in FIGS. 23 and 24) and disengage from the trigger lock element 372.

Figure 25:
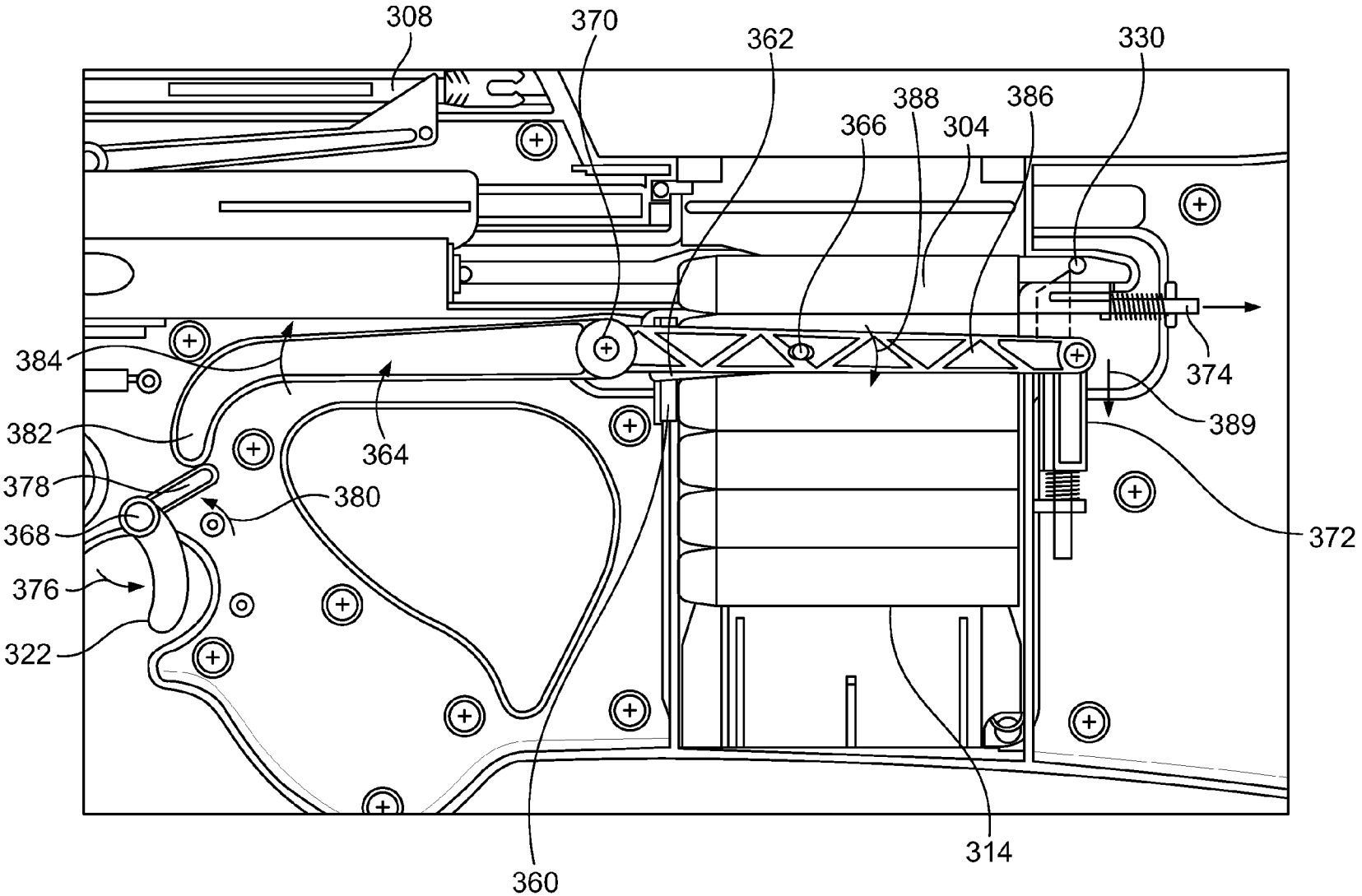
FIG. 25 is an enlarged side elevation view of the toy crossbow shown in FIGS. 22-24 at the moment a lower trigger is pulled.

The lower trigger 322 is pivoted around the shaft 368, FIGS. 23 and 25, such that when the trigger is pulled as symbolized by an arrow 376, a link 378 rotates counterclockwise as symbolized by an arrow 380. This pushes a forward end portion 382 of the trigger link 364, forward of the fastener 370, pivots upward as symbolized by the arrow 384. In return a trigger link portion 386 located rearward of the fastener 370 pivots downward as symbolized by the arrow 388. If the dart lock element 374 has been moved rearward by a dart, such as the dart 304, the trigger lock element 372 will move downward as indicated by the arrow 389, and the cord 330 will be released. Simultaneously, the gate link 362 rotates downward and lowers the dart gate 360 so that no impediment is presented to interfere with discharge of the dart 304. If no dart is loaded, the dart lock element 374 does not move rearward, instead, the dart lock element 374 maintains engagement with the trigger lock element 372 to prevent the trigger lock element from moving downward.

In the alternative, the toy crossbow 300 may not have the dart magazine and instead may be loaded with one dart at a time. Even with the dart magazine, the crossbow 300 may be loaded one dart at a time. It is noted that a slide lock element to prevent movement of the trigger lock element 372 until the cocking handle 320 is returned to its forward position is not shown, but a slide lock element similar to the slide lock elements described in detail above in relation to the toy crossbows 10, 12 may be added as a second safety lock.

The upper crossbow 306, FIG. 22, may be manually loaded where the bolt 308, upon loading, engages and stretches the upper cord 328. The upper trigger 324, FIG. 23, is pivoted around a shaft 390, FIG. 23, and is biased by a spring 392. The upper trigger 324 is connected to a first horizontally moving upper link 394, the first upper link 394 is connected to a second upper link 396 that is pivoted about a shaft 398 and the second upper link 396 is connected to a third upper link 400. When the upper trigger 324 is pulled, the first upper link 394 pivots the second upper link 396, which in turn moves the third upper link 400 so that an end portion 402 releases the cord to discharge the bolt 308.

It is noted that throughout this detailed description, words such as "forward," "rearward," "front," "rear," "top-most" and "bottom," as well as similar positional terms, refer to portions or elements of the launch apparatus as they are viewed in the drawings relative to other portions, or in relationship to the positions of the apparatus as it will typically be held and moved during play by a user, or to movements of elements based on the configurations illustrated.

Figure 26:
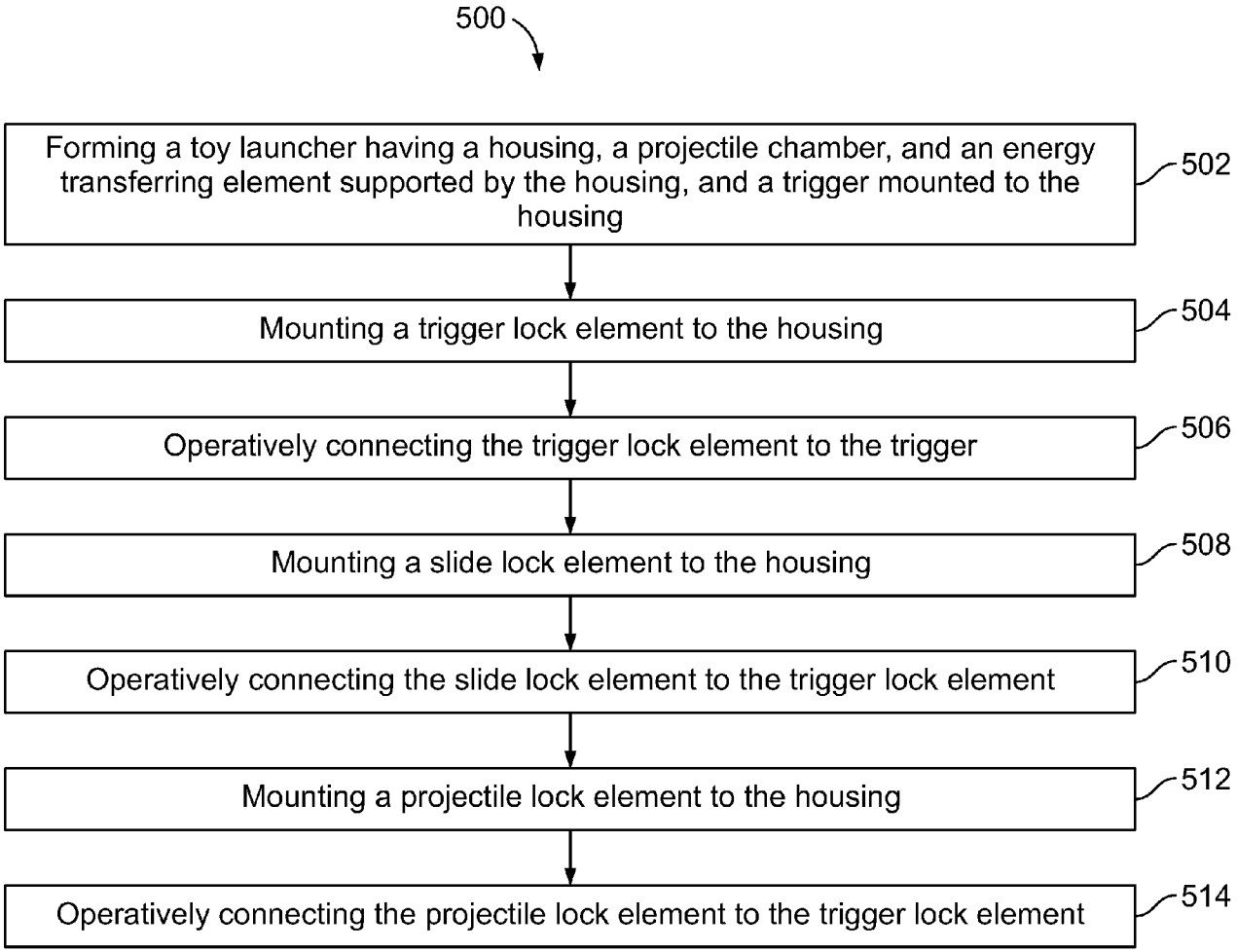
FIG. 26 is a flow diagram of a method for making a toy launch apparatus with two safety locks.

The present invention also includes a method 500, FIG. 26, for making a toy launcher or launch apparatus having safety locks, the method including the steps of forming a toy launch apparatus 502 having a housing supporting a projectile chamber, an energy generating mechanism, such as the cords 18, 44, a cocking slide, and a trigger mounted to the housing, mounting a trigger lock element to the housing 504, operatively connecting the trigger lock element to the trigger 506, the trigger lock element being moveable between first and second positions, mounting a slide lock element to the housing 508, operatively connecting the slide lock element to the trigger lock element 510 to selectively engage the trigger lock element when in the first position, mounting a projectile lock element to the housing 512, and operatively connecting the projectile lock element to the trigger lock element 514 to selectively engage the trigger lock element when in the first position. The method may also include mounting the trigger lock element to move in a first direction, and mounting the slide lock element and the projectile lock element to move in a second direction generally perpendicular to the first direction.

The toy launch embodiments each with safety locks disclosed in detail above have great play value, are fun to use and easy to operate, and are safe, even for young children, and yet the launch apparatus have robust, but simple structures, that may be produced at reasonable cost. The double decker toy launch embodiment 300 may have even greater play value because of the bolt.

From the foregoing, it can be seen that there has been provided features for improved toy launch apparatus and a disclosure of a method for making the improved toy launch apparatus, as well as the safety locking features that protect the user of the launch apparatus against inadvertent engagement of a stretched cord with a cocking slide, and against discharge of an improperly configured projectile. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy projectile launch apparatus with two safety locks for the trigger comprising:

a housing for supporting a toy projectile, an energy generating mechanism, a trigger, two safety locks and a cocking slide;

the trigger is pivotally mounted to the housing;

a trigger lock element is mounted to the housing and connected to the trigger, the trigger lock element including a tab for restraining the energy generating mechanism wherein moving the trigger enables the trigger lock element to move linearly in a first direction between a first restraining position and a second releasing position;

a projectile lock element mounted to the housing and moveable linearly in a second direction between a first locked position and a second unlocked position; and a slide lock element mounted to the housing and moveable linearly in the second direction between a first locked position and a second unlocked position, wherein the second direction is generally perpendicular to the first direction, the projectile lock element and the slide lock element engage the trigger lock element when the trigger lock element, the slide lock element and projectile lock element are in their first positions to prevent the trigger lock element from moving from the trigger element first position to the trigger lock element second position, and the slide lock element is in the slide lock element second position disengaged from the trigger lock element after the cocking slide moves in the second direction from a forward position to a rearward position and then back to the forward position.

2. The toy projectile launch apparatus of claim 1, wherein:

the projectile lock element is in the projectile lock element second position disengaged from the trigger lock element after a properly configured projectile engages the projectile lock element.

3. The toy projectile launch apparatus of claim 1, wherein:

the trigger lock element includes first and second notches, one notch for receiving the projection lock element and the other notch for receiving the slide lock element.

4. The toy projectile launch apparatus of claim 1, wherein:

the slide lock element includes a rod, a lock link at one end of the rod and an abutment link with a surface at the other end of the rod. the lock link for engaging the trigger lock element.

5. The toy projectile launch apparatus of claim 1, wherein:

the projectile lock element includes a nose component and a bar component, the nose component for engaging a toy projectile and the bar component for engaging the trigger lock element.

6. The toy projectile launch apparatus of claim 1, wherein:

the projectile lock element is in the projectile lock element second position disengaged from the trigger lock element after a properly configured projectile engages the projectile lock element;

the trigger lock element includes first and second notches, one notch for receiving the projection lock element and the other notch for receiving the slide lock element;

the slide lock element includes a rod, a lock link at one end of the rod and an abutment link with a surface at the other end of the rod, the lock link for engaging the trigger lock element; and the projectile lock element includes a nose component and a bar component, the nose component for engaging a toy projectile and the bar component for engaging the trigger lock element.

7. A method for making a toy launch apparatus having two trigger safety locks, the method comprising the steps of:

forming a toy launcher having a housing for supporting a projectile chamber, an energy transferring element, and a cocking slide;

mounting a trigger to the housing;

mounting a trigger lock element to the housing;

operatively connecting the trigger lock element to the trigger, the trigger lock element being moveable between a first position and a second position;

mounting a slide lock element to the housing;

operatively connecting the slide lock element to the trigger lock element to selectively engage the trigger lock element when the trigger lock element is in the first position;

locating the slide lock element to be movable by the cocking slide to disengage the slide lock element from the trigger lock element;

mounting a projectile lock element to the housing;

operatively connecting the projectile lock element to the trigger lock element to selectively engage the trigger lock element when the trigger lock element is in the first position;

mounting the trigger lock element to move in a first direction;

mounting the slide lock element to move in a second direction:

mounting the projectile lock element to move in the second direction; and locating the projectile lock element to be movable by a properly configured projectile to disengage the projectile lock element from the trigger lock element.

* * * * *